US008413998B2

(12) United States Patent
Sano

(10) Patent No.: US 8,413,998 B2
(45) Date of Patent: Apr. 9, 2013

(54) ROLLER SKATES

(76) Inventor: Mitetsu Sano, Saitama (JP)

( * ) Notice: Subject to any disclaimer, the term of this patent is extended or adjusted under 35 U.S.C. 154(b) by 0 days.

(21) Appl. No.: 12/442,734

(22) PCT Filed: Jul. 6, 2007

(86) PCT No.: PCT/JP2007/000738

§ 371 (c)(1),
(2), (4) Date: Mar. 25, 2009

(87) PCT Pub. No.: WO2008/041345

PCT Pub. Date: Apr. 10, 2008

(65) Prior Publication Data

US 2010/0109265 A1 May 6, 2010

(30) Foreign Application Priority Data

Oct. 4, 2006 (JP) ..... 2006-273020

(51) Int. Cl.
*A63C 17/04* (2006.01)

(52) U.S. Cl.
USPC ..... 280/11.25; 280/11.222; 280/7.13

(58) Field of Classification Search ..... 280/11.27, 280/11.28, 11.233, 11.25, 11.24, 7.13, 11.222
See application file for complete search history.

(56) References Cited

U.S. PATENT DOCUMENTS

| | | | | |
|---|---|---|---|---|
| 864,622 | A * | 8/1907 | Domis | 280/11.25 |
| 2,212,589 | A * | 8/1940 | Decker William H | 280/11.25 |
| 4,310,168 | A * | 1/1982 | Macaluso | 280/11.24 |
| 4,323,259 | A * | 4/1982 | Boudreau | 280/7.13 |
| 5,951,028 | A * | 9/1999 | Lovitt et al. | 280/11.222 |
| 6,273,437 | B1 * | 8/2001 | Lovitt et al. | 280/11.233 |
| 6,959,933 | B1 * | 11/2005 | Roth | 280/11.25 |
| 2001/0054804 | A1 * | 12/2001 | Lovitt et al. | 280/11.233 |
| 2010/0084830 | A1 * | 4/2010 | Biesse | 280/11.25 |

FOREIGN PATENT DOCUMENTS

| | | | |
|---|---|---|---|
| CN | 2129162 | Y | 4/1993 |
| JP | 2001-510718 | A | 8/2001 |
| JP | 2003-325725 | A | 11/2003 |

* cited by examiner

*Primary Examiner* — Hau Phan
(74) *Attorney, Agent, or Firm* — Law Offices of Peter H. Priest, PLLC

(57) ABSTRACT

[Problem to be Solved] To provide a roller skate in which the inclination of a shoe can be firmly stabilized and the user can easily apply force to the ankle.
[Solution] A pair of roller skates 1 provided with wheels 3 and a sole 10 rotatably holding the wheels 3. In each of a pair of the roller skates 1, the wheels 3 are provided with one front wheel 3*a* and one rear wheel 3*b*. The front wheel 3*a* is provided on the inside of a shoe body 2 provided over the sole 10, and the rear wheel 3*b* is provided on the outside of the shoe body 2.

11 Claims, 25 Drawing Sheets

ROLLER SKATES

TECHNICAL FIELD

The present invention relates to a pair of roller skates provided with a wheel, a sole rotatably holding the wheel, and a shoe body.

BACKGROUND ART

Conventionally, roller skates with two wheels on one skate have wheels disposed generally in series in relation to the traveling direction as shown in Patent Document 1. Further, wheels of a relatively large size whose wheel size is about 16 cm are disposed generally in series on the outside of a shoe body, and the wheels are provided to incline in relation to the ground in such a way that ground contact points on the ground are right under the shoe body, so that it is possible to easily gain speed.

Patent Document 1 Patent application publication 2001-510718

DISCLOSURE OF THE INVENTION

Problem to be Solved by the Invention

However, as the wheels are disposed generally in series, the ground contact points are also generally in series. Therefore, it is necessary to balance the left and the right with the ground contact points as an axis. In other words, a user needs to balance the left and the right by calcaneus pronation, which is an action to push an ankle outward, and calcaneus supination, which is an action to push an ankle inward. These actions cause so large load on the ankle that these actions seem to be inappropriate from a viewpoint of ergonomics. In other words, the user has difficulty in keeping balance while supporting his or her weight by calcaneus pronation and calcaneus supination. Specifically, when the shoe body inclines, force is applied to an ankle in a counteracting direction to recover balance. However, the balance may not be recovered because the force is not sufficient. Therefore, the user may suffer injury such as a sprained ankle or the like.

An object of the present invention made in view of such situations described above is to provide roller skates with two wheels on one skate, in which force is easily applied to an ankle, and inclination of a shoe can be firmly stabilized.

Means for Solving the Problem

In order to solve the foregoing problem, a first aspect of the present invention is a pair of roller skates, including: a wheel; and a sole rotatably holding the wheel; in each of which the wheel is provided with one front wheel and one rear wheel, the front wheel is provided on the inside of a shoe body provided over the sole, and the rear wheel is provided on the outside of the shoe body.

Here, "the inside of a shoe body" refers to an inside within a line that connects the center of the heel and the third toe of the shoe body, and "the outside of the shoe body" refers to an outside beyond the line that connects the center of the heel and the third toe of the shoe body.

According to the roller skates in the first aspect of the present invention, the wheel is provided with one front wheel and one rear wheel, the front wheel is provided on the inside of the shoe body provided over the sole, and the rear wheel is provided on the outside of the shoe body. Therefore, it is possible to incline a shoe in accordance with a direction where an ankle can easily move on the basis of ergonomics. In other words, it is possible to easily apply force to the ankle to firmly stabilize inclination of the shoe. As a result, the ankle does not swing unstably, and stability is excellent.

Further, it is possible to form a structure such that the base of a thumb is located on a line that connects two ground contact points where the front wheel and the rear wheel touch the ground. Therefore, when the center of gravity is moved to apply load on the base of a thumb, instability is not caused, and it is possible to take a firm step to give a kick.

In addition, an ankle does not swing unstably. Therefore, it is possible to provide the shoe body in a shape that is lower than an ankle or in a shape of a so-called low cut. In other words, it is not necessary to provide the shoe body of a boot type, in which a part above an ankle is firmly fixed, or in a shape of a so-called high cut as in a conventional art.

A second aspect of the present invention is according to the first aspect, in which the front wheel is constituted to have a front end side thereof inclining to the inside in relation to the rear wheel around a pivot in the Z-axis direction, where the width direction of the front wheel and the rear wheel in relation to the traveling direction is an X-axis direction, a longitudinal direction as the traveling direction of the front wheel and the rear wheel is a Y-axis direction, and a direction orthogonal to the X-axis direction and the Y-axis direction is a Z-axis direction.

According to the second aspect of the present invention, the front wheel is constituted to have a front end side inclining to the inside in relation to the rear wheel around a pivot in the Z-axis direction besides an operational effect similar to that of the first aspect. Therefore, force that causes a turn to the inside of the traveling direction is generated in a status where the roller skate is not inclined. For example, force that causes a turn to the left side is generated in the case of a roller skate on the right foot. As a result, the user can make a turn to the inside.

In addition, when the user slightly inclines the roller skate to the outside with a roll axis as a pivot, the ground contact points at the front wheel and the rear wheel are displaced, and force that causes movement to the outside is generated. For example, force that causes movement to the right side is generated in the case of a roller skate on the right foot. As a result, because the force that causes movement to the outside is offset against the force that causes a turn to the inside, the user can go straight.

Furthermore, when the user further inclines the roller skate to the outside with the roll axis as a pivot, the ground contact points at the front wheel and the rear wheel are further displaced, and the force that causes movement to the outside is increased. Therefore, the force that causes movement to the outside can overcome the force that causes a turn to the inside. For example, the force that causes movement to the right side can overcome the force that causes a turn to the left side in the case of a roller skate on the right foot. As a result, the user can move to the outside.

In other words, as angular difference is provided in the traveling direction between the front wheel and the rear wheel, the user only needs to adjust an angle at which inclination is made around the roll axis of the roller skate as a pivot to proceed in the left and the right directions as well as to go straight.

A third aspect of the present invention is according to the second aspect, in which angular difference between the front wheel and the rear wheel around the pivot in the Z-axis direction is constituted to be 2.5 degrees or less within a range where a ratio obtained by dividing distance between the front wheel and the rear wheel in the Y-axis direction by distance there between in the X-axis direction is from 1.6 to 2.5.

According to the third aspect of the present invention, the angular difference between the front wheel and the rear wheel around the pivot in the Z-axis direction is constituted to be 2.5 degrees or less within a range where the ratio obtained by dividing the distance between the front wheel and the rear wheel in the Y-axis direction by distance therebetween in the X-axis direction is from 1.6 to 2.5 besides an operational effect similar to that of the second aspect. The third aspect is very effective in such a case.

A fourth aspect of the present invention is according to any one of the first to the third aspects, in which the diameter of the wheel is constituted to be larger than distance from a ground contact point where the wheel touches the ground to the sole.

According to the fourth aspect of the present invention, the diameter of the wheel is constituted to be larger than the distance from a ground contact point where the wheel touches the ground to the sole besides an operational effect similar to that of any one of the first to the third aspects. Therefore, the wheel can smoothly roll on the ground during running. As a result, the fourth aspect is very effective during running at high speed.

A fifth aspect of the present invention is according to any one of the first to the fourth aspects, in which, of axles of the front wheel and the rear wheel, at least the position of the axle of the front wheel is located above the sole.

According to the fifth aspect of the present invention, of axles of the front wheel and the rear wheel, at least the position of the axle of the front wheel is located above the sole besides an operational effect similar to that of any one of the first to the fourth aspects. Therefore, the user can move positions of his or her feet closer to the treads. As a result, stability is further increased. In particular, the fifth aspect is effective when the front wheel is large.

A sixth aspect of the present invention is according to any one of the first to the fifth aspects and further includes brake means that can cause deceleration during proceeding, in which the brake means is disposed on the sole on the inside of the rear wheel, and the brake means is provided to be able to touch the ground when the roller skate is inclined to the inside.

The sixth aspect of the present invention further includes the brake means that can cause deceleration during proceeding, in which the brake means is disposed on the sole on the inside of the rear wheel, and the brake means is provided to be able to touch the ground when the roller skate is inclined to the inside besides an operational effect similar to that of any one of the first to the fifth aspects. Therefore, as inclination is caused around the roll axis as a pivot, steady breaking can be easily performed.

In addition, the brake means is disposed on the sole on the inside of the rear wheel. In other words, the brake means can be provided not to protrude from behind the rear wheel. Therefore, when the user is skating to make a turn, he or she is not hindered from skating with the legs crossed or from taking a so-called cross action.

Moreover, the brake means is disposed on a heel side or the rear wheel side. Therefore, it is easy to apply weight in comparison to the case where the brake means is disposed on the toe side. In other words, negative acceleration can be increased, and distance of movement before a stop can be made short.

Furthermore, a pair of the brake means can be provided on the soles of the left and the right roller skates. In this case, braking distance can be made shorter in comparison to the case where the brake means is provided only on one side.

In addition, besides at the time of the cross action, when a foot kicks to move forward, the brake means does not hinder kicking because the brake means does not project from behind of the rear wheel. For example, when the left foot forward with the right foot located in the rear direction as a base foot, the left foot can kick smoothly. In other words, the left foot and the right foot do not collide with each other.

A seventh aspect of the present invention is according to any one of the first to the sixth aspects, in which the front wheel is constituted to have an upper end side thereof inclining to slant to the inside.

According to the seventh aspect of the present invention, the front wheel is constituted to have an upper end side thereof inclining to slant to the inside besides an operational effect similar to that of any one of the first to the sixth aspects. Therefore, the ground contact point of the front wheel can be constituted not to be located on a lateral side of a foot but to be located right under the foot or a bottom of the foot in the X-axis direction. As a result, stability at the time when the user skates can be increased.

An eighth aspect of the present invention is according to the seventh aspect, in which an inclination angle at which the upper end side of the front wheel is constituted to slant to the inside in relation to a direction perpendicular to a tread is 15 degrees or less.

According to the eighth aspect of the present invention, the inclination angle at which the upper end side of the front wheel slants to the inside in relation to a direction perpendicular to a tread is constituted to be 15 degrees or less besides an operational effect similar to that of the seventh aspect. The eighth aspect is very effective in such a case.

A ninth aspect of the present invention is according to any one of the first to the eighth aspects, in which the shoe body has a main body part that covers a foot and a cuff part provided rotatably in relation to the main body part that covers a leg, and a rotation axis of the cuff part is constituted to incline to a side of a line that connects a ground contact point of the front wheel and a ground contact point of the rear wheel in relation to the X-axis direction.

Here, the "foot" refers to a part below an ankle. On the other hand, the "leg" refers to a part above an ankle.

According to the ninth aspect of the present invention, the shoe body has the main body part that covers a foot, and the cuff part provided rotatably in relation to the main body part that covers a leg, and the rotation axis of the cuff part is constituted to incline to the side of the line that connects a ground contact point of the front wheel and a ground contact point of the rear wheel in relation to the X-axis direction besides an operational effect similar to that of any one of the first to the eighth aspects. Therefore, when an ankle is in a status of so-called outside turn, this structure can reduce load applied on the rotation axis of the cuff part in comparison to the case where the rotation axis is not inclined in relation to the X-axis direction. As a result, the structure can reduce the possibility that the cuff part gets broken.

In addition, the structure can reduce the possibility that the user is hindered from making an outside turn in comparison to the case where the rotation axis is not inclined in relation to the X-axis direction. In other words, the user can easily make an outside turn in comparison to the case where the rotation axis is not inclined in relation to the X-axis direction, Furthermore, when the user makes an outside turn, the user can easily apply weight on the cuff part in comparison to the case where the rotation axis is not inclined in relation to the X-axis direction. As a result, the user can easily adjust the position of the roller skates. In other words, stability can be increased during running.

A tenth aspect of the present invention is according to the ninth aspect, in which an inclination angle of the rotation axis of the cuff part in relation to the X-axis direction is constituted to be 35 degrees or less.

According to the tenth aspect of the present invention, the inclination angle of the rotation axis of the cuff part in relation to the X-axis direction is constituted to be 35 degrees or less besides an operational effect similar to that of the ninth aspect. The tenth aspect is very effective in such a case.

An eleventh aspect of the present invention is according to the ninth or the tenth aspect, in which the rotation axis of the cuff part is constituted to have the inside inclining toward the upper side to become distant in relation to the X-axis direction on surface formed by the X-axis and the Z-axis.

According to the eleventh aspect of the present invention, the rotation axis of the cuff part is constituted to have the inside inclining toward the upper side to become distant in relation to the X-axis direction on the surface formed by the X-axis and the Z-axis besides an operational effect similar to that of the ninth or the tenth aspect. Therefore, this structure makes it possible to adjust a track at the time when the cuff part rotates. Specifically, it is possible to adjust degree of inclination in the Y-axis direction in relation to inclination in the X-axis direction at the time when the cuff part is inclined. As a result, it is possible to adjust a track of a leg at the time when the user makes an outside turn. Thus, stability can be increased during running.

A twelfth aspect is according to the eleventh aspect, in which the inclination angle of the rotation axis of the cuff part in relation to the X-axis direction on the surface formed by the X-axis and the Z-axis is constituted to be 30 degrees or less.

According to the twelfth aspect of the present invention, the inclination angle of the rotation axis of the cuff part in relation to the X-axis direction on the surface formed by the X-axis and the Z-axis is constituted to be 30 degrees or less besides an operational effect similar to that of the eleventh aspect. The twelfth aspect is very effective in such a case.

BEST MODE FOR CARRYING OUT THE INVENTION

An embodiment of the present invention will be described hereinafter with reference to accompanying drawings.

FIG. 1 shows a side view (an inside of a right foot) showing a roller skate according to the present invention. In addition, FIG. 2 shows a rear view (a right foot) showing the roller skate according to the present invention. Further in addition, FIGS. 3 (A), (B), and (C) show schematic plan views of the roller skate according to the present invention. Among these, FIG. 3 (A) shows a status of an outside turn or a status where the roller skate is inclined to the left side (inside), FIG. 3 (B) shows a status where the roller skate is not inclined, and FIG. 3 (C) is a status of an inside turn or a status where the roller skate is inclined to the right side (outside).

Here, a left and right pair of roller skates are in a relationship of axial symmetry with the left foot and the right foot. Therefore, the roller skate of the right foot will be described in this specification of the subject application, and description of the roller skate of the left foot will be omitted.

As shown in FIG. 1 to FIGS. 3 (A), (B), and (C), a roller skate 1 is provided with a shoe body 2 and a sole 10 integrally fixed on a lower part of the shoe body 2 by screws. The shoe body 2 is a so-called low-cut type, which does not cover an ankle. Meanwhile, the sole 10 is provided with a frame 11 as a base and two wheel axles 23, 23 that project from the frame 11 to the left and to the right respectively. In addition, two wheels 3 are provided on the roller skate 1 on one side (the right side here). One is a front wheel 3*a* and the other is a rear wheel 3*b*, which are rotatably provided on the wheel axles 23, 23 respectively. The front wheel 3*a* and the rear wheel 3*b* are provided to be perpendicular to the ground in the status where the roller skate 1 is not inclined in relation to the ground. Moreover, the wheel axles 23, 23 are provided horizontally in relation to the ground. A swing pivot shaft 22 described later is provided to be perpendicular to the ground.

In addition, the front wheel 3*a* is provided on the inside of the thumb or on the left side of the shoe body 2 in the case of the roller skate 1 for the right foot. On the other hand, the rear wheel 3*b* is provided on the outside of the heel or on the right side of the shoe body 2. Moreover, the diameters of the wheels 3 are provided to be larger than distance of the shoe body 2 from the ground. Therefore, the wheels 3 are larger in comparison to a model in which wheels are provided right under the shoe body 2. Therefore, it is possible to easily gain speed.

Further, the sole 10 is provided with angle varying means 20, 20 that can swing the wheel axles 23, 23 around the swing pivot shaft 22 as a pivot in relation to the frame 11. A detailed description of the angle varying means 20, 20 will be given later.

In addition, a brake shoe 51 as brake means 50 that can generate frictional resistance by touching the ground during deceleration or stopping is provided on the rear wheel side on the sole 10 on the inside of the rear wheel 3*b*.

Furthermore, the diameters of the front wheel 3*a* and the rear wheel 3*b* are constituted to be larger than distance from the ground to the sole 10. In the embodiment, the diameters of the front wheel 3*a* and the rear wheel 3*b* are about 18 cm. Therefore, it is possible to reduce rolling resistance caused by rolling of the front wheel 3*a* and the rear wheel 3*b* touching the ground during running. In other words, it is possible to make the front wheel 3*a* and the rear wheel 3*b* roll on the ground smoothly. As a result, it becomes easy to run at high speed.

As shown in FIGS. 3 (A), (B), and (C), there are two ground contact points: a ground contact point S1 where the front wheel 3*a* touches the ground and a ground contact point S2 where the rear wheel 3*b* touches the ground. It is possible to incline the roller skate 1 from a neutral status (FIG. 3 (B)) to the inside (FIG. 3 (A)) and to the outside (FIG. 3 (C))) around a roll axis R, which is a line that connects the two ground contact points (S1, S2). At this time, the angle varying means 20, 20 described later are provided such that the traveling direction can be changed to the inside or in the left direction when inclination is made to the inside (FIG. 3 (A)) by the angle varying means 20, 20, and that the traveling direction can be changed to the outside or in the right direction when inclination is made to the outside (FIG. 3 (C)) by the angle varying means 20, 20.

FIGS. 4 (A), (B), and (C) show schematic side views showing how to incline the roller skate. Among these, FIG. 4 (A) shows a status of inside inclination, FIG. 4 (B) shows a neutral position, and FIG. 4 (C) shows a status of outside inclination.

Further, FIGS. 5 (A) and (B) are schematic views showing how to bend an ankle based on ergonomics. Among these, FIG. 5 (A) shows a so-called "outside turn," while FIG. 5 (B) shows a so-called "inside turn."

As shown in FIG. 4 (A), when the ankle is in the status of the "outside turn," it is possible to incline the roller skate 1 to the inside as shown in FIG. 3 (A).

In addition, as shown in FIG. 4 (B), when the ankle is not bent, it is possible to set the roller skate 1 in the neutral status as shown in FIG. 3 (B).

Further, as shown in FIG. 4 (C), when the ankle is in the status of the "inside turn," it is possible to incline the roller skate 1 to the outside as shown in FIG. 3 (C).

The "outside turn" and the "inside turn" will be described hereinafter in detail.

The status shown at the right end in FIG. 5 (A) is the "outside turn." Specifically, this is a combination of a so-called "dorsiflexion" in which the calcaneal tendon is extended, a so-called "abduction" in which the toes are directed to the outside, and a so-called "calcaneal pronation" in which the heel is pushed to the outside.

On the other hand, the status shown on the right side in FIG. 5 (B) is the "inside turn." Specifically, this is a combination of a so-called "plantar flexion" in which the instep is extended, a so-called "adduction" in which the toes are directed to the inside, and a so-called "calcaneal supination" in which the heel is pushed to the inside.

A stroke caused by bending the foot can be provided longer in comparison to the case where the combinations are not made by the "outside turn" and the "inside turn." Therefore, the user can easily adjust degree at which he or she inclines the roller skate 1 to the inside and to the outside.

In addition, more muscles, sinews, tendons, and ligaments are used in comparison to the case where the combinations are not made by the "outside turn" and the "inside turn." Therefore, the user can easily apply force when making the "outside turn" and the "inside turn." In other words, degree of inclination can be easily and finely adjusted. In addition, the inclination can be easily maintained. In other words, the position of the ankle can be stabilized.

The roller skate 1 in the embodiment has the front wheel 3*a* disposed on the inside thereof and the rear wheel 3*b* disposed on the outside thereof. Consequently, the roll axis R can be provided generally in the same position with a rotation axis at the time when the "outside turn" and the "inside turn" of the ankle are made. In other words, the roller skate 1 in the embodiment has a direction of the roll axis R determined on the basis of ergonomics. Therefore, load applied on the user's ankle is very small, and the position of the roller skate 1 can be stabilized. As a result, it is not necessary to constitute a so-called high-cut type, in which an ankle is covered and fixed, as a conventional roller skate, and it is possible to constitute a so-called low-cut type, in which an ankle is not covered. In addition, a stroke caused by bending an ankle is more sufficiently secured by the low-cut type when the "outside turn" and the "inside turn" are made.

In addition, if the roll axis R is constituted to passes right under the base of the thumb, it is easy to apply weight when making a dash at start or the like. In other words, weight can be applied in the position in which weight can be applied most easily. Moreover, even when weight is strongly applied in the position, stability is excellent, and instability is not caused.

Furthermore, when the brake shoe 51 is made to touch the ground, it is only necessary to increase degree at which the roller skate 1 is inclined to the inside to stably decelerate and stop. At this time, three points of the roller skate 1 on the right foot side touch the ground, including the two ground contact points (S1, S2) of the wheels 3. Therefore, the position of the roller skate 1 can be remarkably stabilized. In addition, as the brake shoe 51 is provided on the heel side, it is easier to apply weight thereon in comparison to the case where the brake shoe 51 is provided on the toe side. Further, the brake shoe 51 is disposed on the inside of the rear wheel 3*b* and does not project rearward from the rear wheel 3*b*. Therefore, even when legs are crossed to skate while turning a corner, the brake shoe 51 does not hinder the crossing of the legs.

The angle varying means 20, 20 will be described hereinafter.

FIG. 6 shows a bottom view showing the angle varying means in the neutral position according to the present invention. In addition, FIG. 7 shows a plan view of FIG. 6. Further, FIG. 8 shows a bottom view showing the angle varying means in a swinging status. In addition, FIG. 9 shows a plan view of FIG. 8.

As shown in FIG. 6 and FIG. 7, the sole 10 of the roller skate 1 is provided with the frame 11 as a base and an angle varying means 20 that changes the angle of the wheel axle 23 into the frame. The angle varying means 20 is provided integrally with the wheel axle 23 that rotatably holds the wheels 3 and is provided with a swinging part 21 that swings around the swing pivot shaft 22 as a pivot and a first restriction means 30 and a second restriction means 40 that restrict a swing of the swinging part 21. Here, the wheel axle 23 and the swing pivot shaft 22 are provided in a relationship where the wheel axle 23 and the swing pivot shaft 22 are distant from each other by distance A, which is a relationship of a so-called skew position.

Further, the first restriction means 30 is provided such that a first elastic body 31 restricts the wheel axle 23 and the swinging part 21 from rotating clockwise in FIG. 6 around the swing pivot shaft 22 as a pivot.

Meanwhile, the second restriction means 40 is provided such that a second elastic body 41 restricts the wheel axle 23 and the swinging part 21 from rotating counterclockwise in FIG. 6 around the swing pivot shaft 22 as a pivot.

The first restriction means 30 is provided with the first elastic body 31 that touches a first pressuring part 24 provided on the swinging part 21 and a neutral adjuster 32 that pinches the first elastic body 31 in cooperation with the first pressuring part 24. The neutral adjuster 32 is provided with a fixing part 33 fixed on the frame 11, a moving part 34 that is formed integrally with the fixing part 33 and moves by flexing itself to touch the first elastic body 31, and a first screw 35 that is provided on the fixing part 33 and enables the moving part 34 to move in relation to the fixing part 33. Therefore, it is possible to slightly move the moving part 34 by turning the first screw 35 in a fastening direction or in a loosening direction. Moreover, the neutral adjuster 32 can determine the position of the swinging part 21 or the neutral position via the first elastic body 31. In other words, rectilinear performance during running straight can be adjusted with accuracy in the status where the roller skate 1 is not inclined to the ground.

The second restriction means 40 is provided with the second elastic body 41 that touches a second pressuring part 25 provided on the swinging part 21, a contact part 42 that restricts a swing of the swinging part 21 in the counterclockwise direction in FIG. 6, and a second screw 43 and a third screw 44 that determine the position of the contact part 42. Among these, the second screw 43 is provided such that the position of the contact part 42 can be finely adjusted by turning the second screw 43 in a fastening direction or in a loosening direction.

The second elastic body 41 is provided to be so thin that the second elastic body 41 does not affect swing displacement of the swinging part 21 even when the second elastic body 41 is elastically deformed.

A description will be given about a case where the roller skate 1 is inclined to the inside by making the outside turn of an ankle.

As shown in FIG. 8 and FIG. 9, when an ankle is in the status of the outside turn to incline the roller skate 1 to the inside, the position of the swinging part 21 in the frame becomes higher than the position of the wheel axle 23 of the front wheel 3*a*. Therefore, force is applied such that the swinging part 21 in the loaded frame pressurizes the wheel axle 23 outside the frame. In other words, force that pushes the swinging part 21 is generated in the wheel axle 23. Moreover, as the skew distance A is provided, the swinging part 21 is swung in the clockwise direction in FIG. 8 around the swing pivot shaft 22 as a pivot based on the principle of leverage. At this time, the first pressuring part 24 of the swinging part 21 and the moving part 34 cause elastic deformation to the first elastic body 31. In other words, as the roller skate 1 is inclined to the inside, the pushing force is increased, and the amount of deformation of the first elastic body 31 is increased. Therefore, it is possible to incline the front wheel 3*a* in the left direction in FIG. 9 as much as the roller skate 1 is inclined to the inside.

When the roller skate 1 is inclined to the inside, force that moves the front wheel 3*a* in FIG. 9 around the swing pivot shaft 22 as a pivot is generated, or force that rotates the front wheel 3*a* in the clockwise direction is generated. However, a setting of the skew distance A is provided such that the pushing force is converted by the skew distance A into force that enables the swinging part 21 to swing in the counterclockwise direction and then becomes larger than the force described above.

In addition, the first restriction means 30 is provided such that the first elastic body 31 can efficiently causes elastic deformation in the swinging direction of the first pressuring part 24.

In addition, when the roller skate 1 is inclined to the inside, the roller skate 1 is inclined around the roll axis R as a pivot as shown in FIGS. 3 (A) and (B). Therefore, the ground contact point S1 of the front wheel 3*a* and the ground contact point S2 of the rear wheel 3*b* move rearward, following inclination of the roller skate 1. In other words, as shown in FIG. 9, the ground contact point S1 of the front wheel 3*a* moves in a direction distant from the swing pivot shaft 22. At this time, the force that pushes the swinging part 21 is generated on the ground contact point S1 of the front wheel 3*a* and applied to the swinging part 21 via the wheel axle 23. In other words, during rolling, the skew distance A becomes longer and varies from A to A', so that the swing of the swinging part 21 is promoted based on the principle of leverage. Further in other words, as the position of the ground contact point S1 varies, the skew distance A becomes longer, and the pushing force can be promoted. As a result, the inclination angle of the front wheel 3*a* can be enlarged.

Furthermore, when the user kicks rearward to gain acceleration, the roller skate 1 is inclined to the inside. Moreover, as load is applied, the swinging part 21 swings, and the first elastic body 31 deforms elastically. At this time, it is possible to use repulsive force with which the first elastic body 31 tries to return to its original shape as propulsive force at the time of acceleration.

On the other hand, when the roller skate 1 is inclined to the outside while the ankle is in the status of the inside turn, the position of the swinging part 21 in the frame becomes lower than the position of the wheel axle 23 of the front wheel 3*a*. Therefore, force is applied such that the swinging part 21 in the loaded frame hangs on the wheel axle 23 outside the frame. In other words, force that pulls out the swinging part 21 is generated in the wheel axle 23, causing a swing in the counterclockwise direction in FIG. 8. At this time, the second pressuring part 25 of the swinging part 21 and the contact part 42 cause elastic deformation to the second elastic body 41. Here, the second elastic body 41 is provided very thinly. Moreover, the swinging part 21 is provided to hardly cause a swing due to effect of restriction by the contact part 42. In other words, the inclination angle of the front wheel 3*a* is provided not to vary even when the roller skate 1 is inclined to the outside.

In addition, the angle varying means 20 equivalent to the angle varying means 20 for the front wheel side is disposed on the rear wheel side by changing the direction by 180 degrees as shown in FIG. 1.

Therefore, while the ankle is made to be in the status of the outside turn, the front wheel 3*a* changes the direction to the left side as shown in FIG. 3 (A) because the swinging part 21 swings as described above, and the rear wheel 3*b* does not change the inclination angle because the swinging part 21 does not swing as described above. As a result, a course can be changed in the left direction during proceeding.

On the other hand, while the ankle is made to be in the status of the inside turn, the front wheel 3*a* does not change the inclination angle as shown in FIG. 3 (C) because the swinging part 21 does not swing due to effect of the pulling force described above. The rear wheel 3*b* changes the direction to the left side because the swinging part 21 swings due to effect of the pushing force described above. As a result, a course can be changed in the right direction during proceeding.

In other words, the user can change the course to the side to which the roller skate 1 is inclined during proceeding.

In addition, because the same angle varying means 20, 20 are provided on the front and on the rear, the cost is low in comparison to the case where different angle varying means are provided.

When the roller skate 1 is inclined, the angle of only either one of the front wheel 3*a* and the rear wheel 3*b* varies in order to decrease the angle of a turnabout during proceeding and to improve stability during high-speed running. Therefore, the second elastic body 41 described above may be thickened to a degree that elastic deformation thereof causes swinging part 21 to swing. In other words, the first restriction means 30 may be provided instead of the second restriction means 40, so that the swinging part 21 may swing when the pulling force is applied. In this case, when the roller skate 1 is inclined, the front wheel 3*a* and the rear wheel 3*b* change the direction to one direction opposite to the other. Therefore, the angle of a turnabout during proceeding becomes large. For example, this is effective for a setting with which a quick turnabout is emphasized such as hockey or the like.

Further, the angle varying means 20 may be provided only on one of the front wheel side and the rear wheel side, and the angle of the wheel axle 23 on the other side may be constituted not to vary. In this case, it is preferable that the first restriction means 30 is provided instead of the second restriction means 40, so that the swinging part 21 is provided to swing even when the pulling force is applied.

The roller skate 1 of the embodiment has a structure that the shoe body 2 and the sole 10 are integrally provided. However, it is understood that the structure may be made such that the shoe body 2 is detachable in relation to the sole 10.

Further, the roller skate 1 of the embodiment is provided with the angle varying means 20. However, even if the angle varying means 20 is not provided, it is possible to change the traveling direction by an operation by the user.

The brake means 50 will be described hereinafter.

The brake shoe 51 provided on the inside of the rear wheel 3*b* in the frame 11 can touch the ground by increasing degree of the outside turn of the ankle. At this time, deceleration can be caused by friction force between the brake shoe 51 and the ground. Further, as for load at this time, when almost all weight is applied on the brake shoe 51, frictional resistance is increased, and weight is hardly applied to the wheels 3. Therefore, the pushing force described above is hardly generated. Therefore, a course is hardly changed during deceleration. In other words, it is possible to stably decelerate. It is also possible to change a course during deceleration by changing load ratio between the brake shoe 51 and the wheels 3.

In addition, as the ankle is moved based on ergonomics, it is possible to easily adjust degree at which the brake shoe 51 is made to touch the ground. Further, stability is very excellent during deceleration because the ground is in contact with three points: the front wheel 3*a*, the rear wheel 3*b*, and the brake shoe 51.

A cover member will be described hereinafter.

FIG. 10 is a bottom view showing a cover member according to the present invention.

As shown in FIG. 10, the sole 10 is provided with a cover member 60 that covers the angle varying means 20 in the frame 11. Therefore, it is possible to protect the angle varying means 20 from dust. Further, when collision is made against a projection on the ground, it is possible to prevent the angle varying means 20 from being broken.

The roller skate 1 in the embodiment is a pair of the roller skates 1 provided with the wheels 3 and the sole 10 rotatably holding the wheels 3. In each of the paired roller skates 1, the wheels 3 are provided with one front wheel 3*a* and one rear wheel 3*b*. The front wheel 3*a* is provided on the inside of the shoe body 2 provided over the sole 10. The rear wheel 3*b* is provided on the outside of the shoe body 2.

In addition, in the roller skate 1 of the embodiment, the sole 10 is provided with the angle varying means 20, 20 for changing the angle in relation to the sole 10 of the wheel axle 23 that supports the wheel 3. The angle varying means 20, 20 are provided with the swing pivot shaft 22 on a sole bottom side of the wheel axle 23 that is a pivot around which the wheel axle 23 swings. The wheel axle 23 is swung around the swing pivot shaft 22 as a pivot such that the traveling direction is changed to a side to which the roller skate 1 is inclined when the roller skate 1 is inclined around the roll axis R as a pivot that is a line connecting the two ground contact points S1, S2 where the front wheel 3*a* and the rear wheel 3*b* touch the ground.

Moreover, in the roller skate 1 of the embodiment, the swing pivot shaft 22 is provided to be perpendicular to the ground and in a positional relationship where the swing pivot shaft 22 is distant from the wheel axle 23 by the skew distance A in the status where the roller skate 1 is not inclined.

In addition, in the roller skate 1 of the embodiment, the angle varying means 20, 20 are constituted such that force is applied for the wheel 3 on the inclined side to push the wheel axle 23 into the sole 10 to change the angle of the wheel axle 23 in relation to the sole 10 when the roller skate 1 is inclined around the roll axis R as a pivot.

Furthermore, in the roller skate 1 of the embodiment, the angle varying means 20, 20 are constituted such that the position of the ground contact point S1 of the front wheel 3*a* (the ground contact point S2 in the case of the rear wheel 3*b*) as the wheel 3 in relation to the swing pivot shaft 22 moves in the direction distant from the swing pivot shaft 22 on the front wheel side (the swing pivot shaft 22 on the rear wheel side in the case of the ground contact point S2 of the rear wheel) when the roller skate 1 is inclined around the roll axis R as a pivot.

Further, in the roller skate 1 of the embodiment, the angle varying means 20, 20 are constituted such that force is applied for the wheel 3 on the side opposite to an inclined side to pull out the wheel axle 23 from the sole 10 to change the angle of the wheel axle 23 in relation to the sole 10 when the roller skate 1 is inclined around the roll axis R as a pivot.

In addition, in the roller skate 1 of the embodiment, the angle varying means 20, 20 is provided with the first elastic body 31 as an elastic body that restricts the wheel axle 23 from swinging around the swing pivot shaft 22 as a pivot. The first elastic body 31 is constituted to cause elastic deformation and to restrict the wheel axle 23 from swinging when the roller skate 1 is inclined.

Furthermore, the diameters of the wheels 3 (3*a*, 3*b*) are constituted to be larger than the distance from the ground contact points S1, S2, where the wheels 3 (3*a*, 3*b*) touch the ground, to the sole 10.

In addition, in the roller skate 1 of the embodiment, the brake shoe 51 is provided as the brake means 50 that can cause deceleration during proceeding. The brake shoe 51 is disposed on the sole 10 on the inside of the rear wheel 3*b*. The brake shoe 51 is provided to be able to touch the ground when the roller skate 1 is inclined to the inside.

Other Embodiment 1

FIG. 11 is a rear view (right foot) showing a roller skate according to other embodiment 1.

As shown in FIG. 11, wheel axles 83, 83 incline in the vertical direction in relation to the ground, and a front wheel 73*a* and a rear wheel 73*b* as wheels 73 are constituted to form the shape of two straight lines whose upper ends are more distant than the lower ends in a rear view. In this case, while an operational effect similar to that of the embodiment described above can be obtained, the external appearance is fine. Other members are the same as those of the embodiment described above. Therefore, the same reference numerals and symbols are used, and description thereabout will be omitted.

Further, it is also possible that the ground contact point of the front wheel 73*a* is constituted to be located in vicinity of a lower part of the base of the thumb. In this case, when the user kicks rearward for acceleration with only the front wheel 73*a* in contact with the ground, it is easy to apply force in relation to the ground. In other words, when the user kicks rearward, the position of the roller skate 1 on the kicking side is stabilized, and the force can be efficiently transmitted to the ground.

It is preferable that inclination of the front wheel 73*a* and the rear wheel 73*b* is in the shape of two straight lines whose upper ends are more distant than the lower ends in a rear view within a range of about 10 degrees or less from the vertical direction in relation to the ground. In this case, while the roll axis R is kept inclined in relation to a line that connects the heel and the third toe in the longitudinal direction of the shoe body 2, or while the roll axis R is kept provided in a direction where the ankle can easily move based on ergonomics, a structure can be made such that load is applied generally in the radial direction of the front wheel 73*a* and the rear wheel 73*b* in the front wheel 73*a* and the rear wheel 73*b*. As a result, stability is excellent, and it is possible to efficiently rotate the front wheel 73*a* and rear wheel 73*b*. In other words, it is possible to reduce useless force that is applied in the direction of the wheel axle (83) in the wheel 73 in comparison to the case where the front wheel and the rear wheel are extremely inclined (by about 45 degrees) in relation to the perpendicular direction to the ground as in the roller skate of the related art.

Therefore, it is possible to efficiently rotate the wheel 73.

In other embodiment 1, the wheels 73 (73*a*, 73*b*) are constituted to be perpendicular to the ground or to form an angle of ten degrees or lower from the vertical direction.

In the embodiment, the front wheel 73*a* is provided more inward than the front wheel 73*a*. However, the front wheel 73*a* may be provided in the front direction of the shoe body 2 and, at the same time, more inward than the line that connects the center of the heel of the shoe body 2 and the third toe. Similarly; in the embodiment, the rear wheel 73*b* is provided more outward than the shoe body 2. However, the rear wheel 73*b* may be provided in the rear direction of the shoe body 2 and, at the same time, more outward than the line that connects the center of the heel of the shoe body 2 and the third toe. In this case, it is possible to elongate distance between the front wheel 73*a* and the rear wheel 73*b* in the longitudinal direction, which is the traveling direction. Therefore, it is possible to improve stability at the time of high-speed running.

Further, the present invention is not limited to the embodiment above. It is recognized that various modifications are possible within the scope of the invention claimed, and that such modifications are also included within the scope of the present invention.

Other Embodiment 2

FIG. 12 is a plan view (right foot) showing a roller skate according to other embodiment 2.

As shown in FIG. 12, a roller skate 101 according to other embodiment 2 has a sole 103 and a shoe body 102 disposed in an upper part of the sole 103. Further, the sole 103 is provided with a front wheel axle 106 on the toe side on the inside and a rear wheel axle 107 on the heel side on the outside. Moreover, a front wheel 104 is rotatably provided on the front wheel axle 106. On the other hand, a rear wheel 105 is rotatably provided on the rear wheel axle 107.

Here, the X-axis direction is a width direction of the shoe body 102. In addition, the Y-axis direction is a longitudinal direction of the shoe body 102, which is the traveling direction during proceeding straight. Further, the Z-axis direction is a direction that orthogonally crosses the X-axis direction and the X-axis direction.

Further, the rear wheel axle 107 is provided in the X-axis direction. Meanwhile, the front wheel axle 106 is provided to incline by θ1 in relation to the rear wheel axle 107 in such a way that the front side (the toe side in the Y-axis direction) of the front wheel 104 approaches the inside. In other words, the front wheel axle 106 is provided such that the direction of proceeding at the ground contact point S1 of the front wheel 104 and the direction of proceeding at the ground contact point S2 of the rear wheel 105 are different. Moreover, a structure is made such that force that effects a turn to the inside is generated while the roller skate 101 proceeds in the status where the roller skate 101 is no inclined around the roll axis R as a pivot.

It is preferable that θ1, which is the angular difference around the Z-axis direction as a pivot between the front wheel 104 and the rear wheel 105, is 2.5 degrees or less within a range where ratio obtained by dividing the distance in the Y-axis direction by the distance in the X-axis direction between the front wheel 104 and the rear wheel 105 is from 1.6 to 2.5.

An operation of the roller skate 101 will be described hereinafter.

FIG. 13 (A) to (C) shows schematic plan views showing an operation of the roller skate according to other embodiment 2. Among these, FIG. 13 (A) shows a status where the roller skate is not inclined around the roll shaft as a pivot. In addition, FIG. 13 (B) shows a status where a slight inclination is made to the outside of the foot around the roll axis as a pivot. Further, FIG. 13 (C) shows a status where a further inclination is made to the outside of the foot from the status in FIG. 13 (B).

FIG. 13 (A) to (C) show the roller skate of the right foot.

As shown in FIG. 13 (A), when the roller skate 101 is not inclined around the roll axis R as a pivot, the direction of proceeding at the ground contact point S1 of the front wheel 104 is more inclined to the inside of the foot than the direction of proceeding at the ground contact point S2 of the rear wheel 105 as described above. Therefore, the roller skate 101 can generate force of turning to the inside of the foot. As a result, when the roller skate 101 of the right foot proceeds in the front direction, the user wearing the roller skate 101 can turn to the left side in the drawing or to the inside of the foot as denoted by an arrow.

As shown in FIG. 13 (B), when the roller skate 101 is slightly inclined to the outside of the foot around the roll axis R as a pivot, the positions of the ground contact points S1, S2 of the front wheel 104 and the rear wheel 105 are displaced. Specifically, the positions of the ground contact points S1, S2 of the front wheel 104 and the rear wheel 105 move to the toe side in relation to the front wheel axle 106 and the rear wheel axle 107. At this time, tangential directions at the ground contact points S1, S2 of the front wheel 104 and the rear wheel 105 are slightly inclined in the clockwise direction of the drawing.

Therefore, force of movement to the right side of the drawing or to the outside of the foot is generated. Moreover, it is possible to offset the force of movement to the right side or to the outside of the foot against the force of turning to the inside (left side) of the foot by the angular difference θ1 described above. As a result, when the roller skate 101 of the right foot proceeds forward, the user wearing the roller skate 101 can go straight as denoted by an arrow.

As shown in FIG. 13 (C), when the roller skate 101 is further inclined to the outside of the foot around the roll axis R as a pivot from the status of FIG. 13 (B), the positions of the ground contact points S1, S2 of the front wheel 104 and the rear wheel 105 are further displaced. Specifically, the positions of the ground contact points S1, S2 of the front wheel 104 and the rear wheel 105 further move to the toe side in relation to the front wheel axle 106 and the rear wheel axle 107 from the status of FIG. 13 (B). At this time, the tangential directions at the ground contact points S1, S2 of the front wheel 104 and the rear wheel 105 are further inclined in the clockwise direction in the drawing from the status of FIG. 13 (B).

Therefore, the roller skate 101 can increase the force of movement to the right side of the drawing or to the outside of the foot. Moreover, the force of moving to the right side or to the outside of the foot can overcome the force of turning to the inside (left side) of the foot by the angular difference θ1 described above. As a result, when the roller skate 101 of the right foot proceeds forward, the user wearing the roller skate 101 can cause movement to the right side of the drawing or to the outside of the foot (hereinafter referred to as slice movement) as denoted by an arrow.

FIG. 14 is a drawing showing how to skate on the roller skate according to other embodiment 2.

As shown in FIG. 14, the roller skate 101 of the left foot kicks the ground contact point first, and the roller skate 101 of the right foot starts to slide. Then, the roller skate 101 of the right foot is stepped in the right front direction in a kicking manner in relation to the traveling direction of the user. At this time, the center of gravity of the user is applied on the roller skate 101 of the right foot.

However, the center of gravity of the user moves further outward from the roller skate 101 of the right foot and may move to the outside of the roller skate 101 of the right foot. In this case, it is difficult to support the center of gravity of the user by the roller skate 101 of the left foot on the inside of the right foot. Therefore, the user may fall down.

With this considered, it is possible to largely incline the roller skate 101 of the right foot according to the invention of the subject application to the outside of the foot. Consequently, as in FIG. 13 (C) described above, while the direction of the roller skate 101 of the right foot in relation to the traveling direction of the user is not changed, or, in other words, while the direction is not displaced in the rotational direction around the Z-axis as a pivot, a slice movement can be caused to the outside of the foot. Therefore, the roller skate 101 of the right foot can be easily moved right under the center of gravity of the user to recover a posture.

After this, when the roller skate 101 of the right foot is returned to an uninclined status, the slice movement is ended. Then, it is possible to take a curve to the inside of the foot to proceed as in FIG. 13 (A) described above.

Moreover, the roller skate 101 of the right foot kicks against the tread, and the roller skate 101 of the left foot is stepped forward in a kicking manner. Thus, the user can slide by applying the center of gravity on the roller skate 101 of the left foot.

As described above, the angular difference θ1 is provided between the direction of the front wheel axle 106 and the direction of the rear wheel axle 107. Consequently, even when the roller skate 101 does not have a structure where the front wheel axle 106 and the rear wheel axle 107 swing, it is possible to proceed by trailing a gradual curve toward the inside of the foot.

Further, when the roller skate 101 is inclined to the outside of the foot around the roll axis R as a pivot, force effecting a gradual turn to the inside of the foot is constantly generated at any degree of inclination. Therefore, as shown in FIG. 14, when there is a difference between the traveling direction of the user and the direction of the roller skate 101 at the time of kicking, it is possible to bring the direction of the roller skate 101 at the time of kicking closer to the traveling direction of the user. As a result, loss of the user's force can be minimized. In other words, the user's force is efficiently converted into force toward the traveling direction of the user.

Furthermore, the angular difference θ1 is provided between the direction of the front wheel axle 106 and the direction of the rear wheel axle 107. Consequently, rectilinear performance at the time when the roller skate 101 is inclined around the roll axis R as a pivot is improved in comparison to the case where the angular difference is not provided. In other words, it is possible to increase a range where the roller skate 101 can slide straight forward or almost straight forward. Specifically, if the angular difference is not provided (in the case of θ1=0°, the roller skate 101 goes generally straight forward in a range where the roller skate 101 is inclined around the roll axis R as a pivot by −10 degrees to 10 degrees (the negative value denotes the inside of the foot, while the positive value denotes the outside of the foot). On the other hand, if the angular difference θ1=1°, the roller skate 101 can proceed generally straight forward in a range where the roller skate 101 is inclined by −20 degrees to 20 degrees.

Further, the roller skate 101 can cause the slice movement as described above. When there are various types of changes on the ground contact point of the roller skate 101 in general such as inclination, waviness, cracks, projections and recesses, pebbles or other obstacles, and manhole covers, the user tends to lose balance. In this case, the user can operate the roller skate 101 of the invention of the subject application by flexibly combining the slice movement to slide stably, and this is very effective.

Furthermore, the roller skate 101 of the invention of the subject application can immediately recover balance by the slice movement. Therefore, it is easy to slide by applying the whole weight on the roller skate 101 of one side. Further, the position of the center of gravity of the user can be adjusted by inclining the roller skate 101 around the roll axis R as a pivot. Therefore, it is possible to slide over a long distance and for a long time by the roller skate 101 on one side. As a result, it is possible to enjoy a comfortable slide with a long stroke.

Further, when the roller skate is inclined around the roll axis as a pivot, and if a wheel inclines, a so-called camber thrust effect can be obtained depending on the shape of the wheel.

Here, the "camber thrust effect" refers to an effect that causes a turn by a difference between the diameters of the inside and the outside of the wheel. For example, when a wide wheel is inclined to the inside (left side), the diameter on the inside becomes smaller than the diameter on the outside at the ground contact point. At this time, the wheel starts to turn to the direction where the diameter is smaller.

The roller skate 101 in other embodiment 2 has a structure in which the front wheel 104 has a front end side thereof inclining to the inside in relation to the rear wheel 105 around a pivot in the Z-axis direction, where the width direction of the front wheel 104 and the rear wheel 105 in relation to the traveling direction is the X-axis direction, the longitudinal direction as the traveling direction of the front wheel 104 and the rear wheel 105 is the Y-axis direction, and the direction orthogonal to the X-axis direction and the Y-axis direction is the Z-axis direction.

Further, in other embodiment 2, it is preferable that the angular difference θ1 between the front wheel 104 and the rear wheel 105 around the pivot in the Z-axis direction is constituted to be 2.5 degrees or less within a range where ratio obtained by dividing distance in the Y-axis direction by distance in the X-axis direction between the front wheel 104 and the rear wheel 105 is from 1.6 to 2.5.

Other Embodiment 3

FIG. 15 shows a rear view (right foot) showing a roller skate according to other embodiment 3.

As shown in FIG. 15, a roller skate 111 according to other embodiment 3 has a front wheel 112 rotatably provided on a front wheel axle 114 and a rear wheel 113 rotatably provided on a rear wheel axle 115.

The front wheel axle 114 is provided to incline by angle θ2 in such a manner that the front wheel 112 slants to the inside around the Y-axis as a pivot. Therefore, it is possible to provide the ground contact point S1 of the front wheel 112 under the foot. As a result, while the user is sliding, stability can be increased.

Other members are the same as those of the embodiments described above. Therefore, the same reference numerals and symbols are used, and description thereabout will be omitted.

In other embodiment 3, the front wheel 112 is constituted to incline by the angle θ2 in such a manner that the upper end thereof slants to the inside.

Further, in other embodiment 3, it is preferable that the inclination angle θ2 at which the upper end of the front wheel 112 slants to the inside in relation to the Z-axis direction, which is the direction perpendicular to the tread, is constituted to be 15 degrees or less.

Other Embodiment 4

FIG. 16 shows a schematic perspective view (right foot) showing a roller skate according to other embodiment 4. In addition, FIG. 17 shows a side view of FIG. 16. Further, FIG. 18 shows a plan view of FIG. 16. Furthermore, FIG. 19 shows a front view of FIG. 16. Further in addition, FIG. 20 shows a schematic cross-sectional plan view showing a roller skate according to other embodiment 4.

A front wheel and a rear wheel are omitted from the drawings.

As shown in FIG. 16 to FIG. 19, a shoe body 122 of a roller skate 121 according to other embodiment 4 has a main body part 123 and a cuff part 124 that is rotatable in relation to the main body part 123. Among these, the main body part 123 is provided to be able to cover a foot of the user. Meanwhile, the cuff part 124 is provided to be able to cover a part of the user's leg.

Here, the "foot" refers to a part below an ankle. Meanwhile, the "leg" refers to a part above an ankle.

Further, the cuff part 124 is connected to the main body part 123 by a first hinge 127 on the inside of the foot and a second hinge 128 on the outside of the foot. Moreover, the cuff part 124 is constituted to be rotatable around a first rotation axis 129 as a pivot, which is a line that connects the first hinge 127 and the second hinge 128. The first hinge 127 and the second hinge 128 are provided to be at the same height (position) in the Z-axis direction. Further, the first hinge 127 is provided closer to the toe side than the second hinge 128 is in the Y-axis direction. Therefore, the first rotation axis 129 can be provided to incline by angle θ3 in relation to the X-axis.

Here, degree of the inclination angle θ3 of the first rotation axis 129 is constituted between the direction of the X-axis and the inclination of the roll axis R (see FIG. 18).

A description will be given by showing the outline of the cuff part 124 by a first part 125*a* to a seventh part 125*g* for easy understanding of the situation of an operation of the cuff part 124. Further, parts on the toe side in the first part 125*a* to the seventh part 125*g* are defined as a first front part 126*a* to a seventh front part 126*g* respectively.

The position of the cuff part 124 is in a position close to the Z-axis direction as shown by a solid line in the status where the user does not incline the right foot. When the user makes the right foot to be in the status of the outside turn, the cuff part 124 can incline obliquely right frontward around the first rotation axis 129 as a pivot as shown by a chain line. The status shown by the chain line is a status where the cuff part 124 inclines obliquely right frontward by 20 degrees, which is the outside and in the front direction of the foot.

As a result, the cuff part 124 can easily rotate in comparison to the case where the rotation axis is provided in the X-axis direction. In addition, the degree of the inclination of the first rotation axis 129 is constituted between the X-axis and the roll axis R. Therefore, the user can apply load on the main body part 123 via the cuff part 124. Consequently, the user can easily adjust the position of the roller skate 121 in relation to the tread around the roll axis R as a pivot with accuracy.

Further, as shown in FIG. 20, degree of the inclination of the first rotation axis 129 is constituted between the X-axis and the roll axis R. Consequently, when the cuff part 124 is inclined to the outside of the foot in the front direction, it can reduce unnatural force that is applied to a portion T1 on the outside of the foot in the front direction and to a portion T2 on the inside of the foot in the rear direction in the cuff part 124 in comparison to the case where the rotation axis is provided in the X-axis direction. As a result, the roller skate 121 of the invention of the subject application can reduce the possibility that the cuff part 124 gets broken.

In other embodiment 4, the shoe body 122 has the main body part 123 that covers a foot and the cuff part 124 provided rotatably in relation to the main body part 123 that covers a leg. The first rotation axis 129 as the rotation axis of the cuff part 124 is constituted to incline by the θ3 in relation to the X-axis direction to the roll shaft that is a line connecting the ground contact point S1 of the front wheel and the ground contact point S2 of the rear wheel.

Further, in other embodiment 4, it is preferable that the inclination angle θ3 of the first rotation axis 129 of the cuff part 124 in relation to the X-axis direction is constituted to be 35 degrees or less.

Other Embodiment 5

FIG. 21 shows a schematic perspective view (right foot) showing a roller skate according to other embodiment 5. In addition, FIG. 22 shows a side view of FIG. 21. Further, FIG. 23 shows a plan view of FIG. 21. Furthermore, FIG. 24 shows a plan view of FIG. 21.

A front wheel and a rear wheel are omitted from the drawings.

As shown in FIG. 21 to FIG. 24, a shoe body 132 of a roller skate 131 according to other embodiment 5 has a main body part 133 and a cuff part 134 that is rotatable in relation to the main body part 133.

The cuff part 134 is constituted to be rotatable around a second rotation axis 137, which is a line that connects a third hinge 135 on the inside of the foot and a fourth hinge 136 on the outside of the foot. The third hinge 135 is provided in a position higher than the fourth hinge 136 in the Z-axis direction. Further, the third hinge 135 is provided closer to the toe side than the fourth hinge 136 is in the Y-axis direction. Consequently, the second rotation axis 137 can be provided to incline by angle θ4 in the direction where the second rotation axis 137 slants to the outside of the foot in relation to the first rotation axis in other embodiment 4 described above (see FIG. 24).

As a result, when the user makes the right foot to be in the status of the outside turn, and when the cuff part 134 is inclined to the outside of the foot in the front direction or in the obliquely right to the front by 20 degrees, it is possible to adjust degree of the inclination to the outside of the foot to be small. The degree of the inclination to the outside of the foot of the cuff part 134 can be adjusted according to a sliding style of the user, and it is possible to improve stability at the time when the user slides.

Other members are the same as those of other embodiment 4 described above. Therefore, the same reference numerals and symbols are used, and description thereabout will be omitted.

In other embodiment 5, the second rotation axis 137, which is the rotation axis of the cuff part 134, is constituted to have the inside inclined by angle θ4 toward the upper side to become distant in relation to the X-axis direction on the surface formed by the X-axis and the Z-axis.

Further, in other embodiment 5, it is preferable that the inclination angle θ4 of the second rotation axis 137 of the cuff part 134 in relation to the X-axis direction on the surface formed by the X-axis and the Z-axis is constituted to be 30 degrees or less.

Other Embodiment 6

FIG. 25 shows a side view (the inside of the right foot) showing a roller skate according to other embodiment 6.

As shown in FIG. 25, a roller skate 141 according to other embodiment 6 has a sole 147 and a shoe body 142. Among these, the shoe body 142 has a main body part 143 and a cuff part 144. Moreover, the cuff part 144 is provided rotatably around a pair of hinges 145, 145 as pivots in relation to the main body part 143. Further, the main body part 143 and the cuff part 144 are provided with straps 146, 146, . . . as fasteners that can fix a foot of the user.

Meanwhile, the sole 147 is provided with a front wheel axle 150 that rotatably holds a front wheel 148, a rear wheel axle 151 that rotatably holds a rear wheel 149, and a brake shoe 152 as brake means. The front wheel 148 is provided on the inside of the foot, while the rear wheel 149 is provided on the outside of the foot. In addition, the brake shoe 152 is provided on the inside of the rear wheel 149. Furthermore, the front wheel axle 150 is provided at the same height as the main body part 143 in the Z-axis direction. Meanwhile, the rear wheel axle 151 is provided in vicinity of the lower end of the heel of the foot in the Z-axis direction.

Consequently, the position of the main body part 143 of the shoe body 142 can be inclined forward. As the position of the main body part 143 is inclined forward, it is possible to reduce a rearward delay of the center of gravity of the user, and it is possible to reduce load on the foot of the user during sliding.

It is understood that the front wheel 148 may be constituted to be smaller than the rear wheel 149 to enable the position of the main body part 143 to incline forward.

In the roller skate 141 in other embodiment 6, at least the position of the axle 150 of the front wheel 148 among the axles (150, 151) of the front wheel 148 and the rear wheel 149 is located above the sole 147.

A lock device that locks both of the front wheel and the rear wheel or one of the front wheel and the rear wheel may be provided. In this case, when sliding is interrupted to go up or down stairs or a steep slope, the user wearing the roller skates can engage the lock to move easily. In other words, the user does not need to remove or attach the roller skates. In particular, when the rear wheel is locked, such movement becomes easy.

Figure 1:
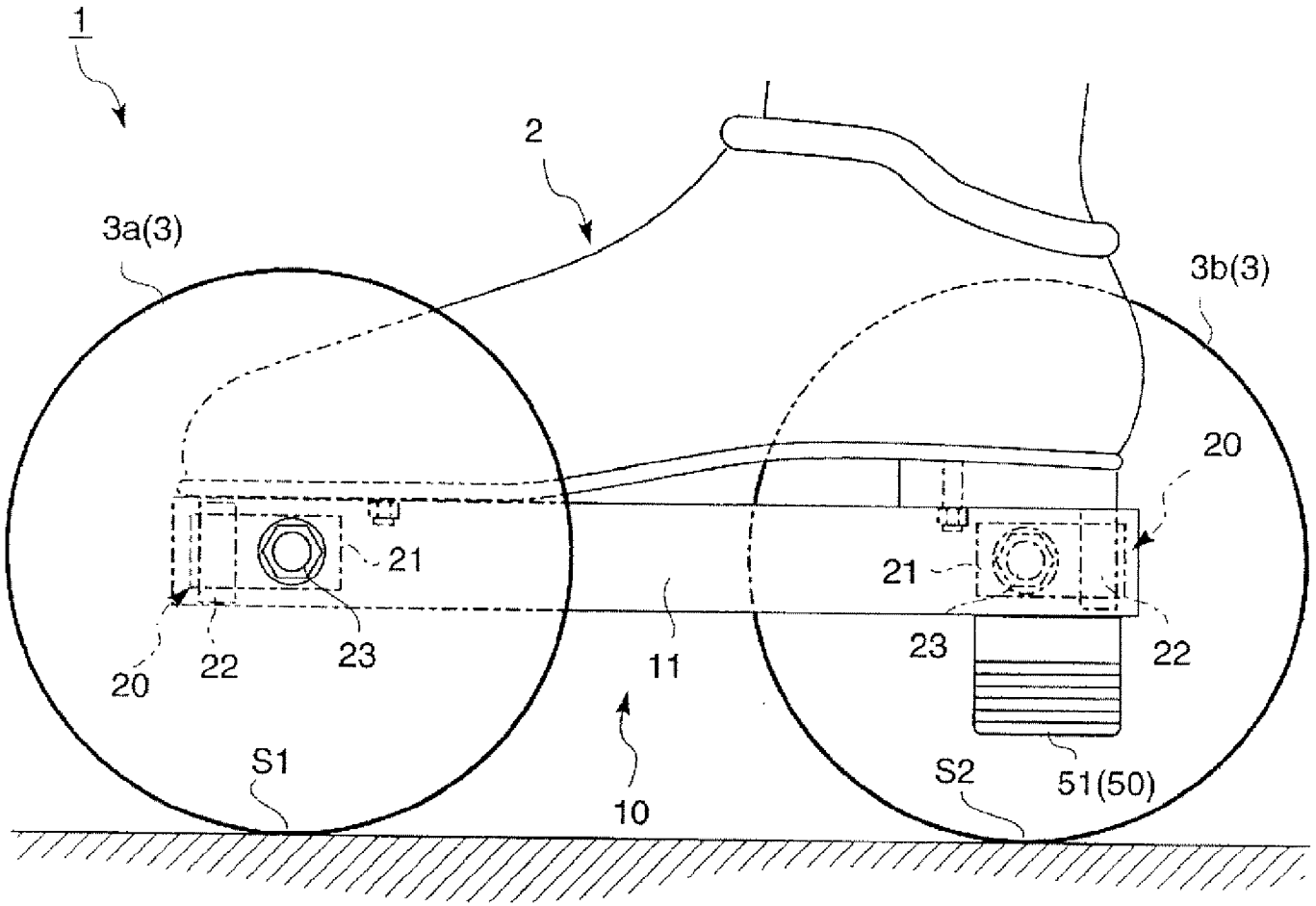
FIG. 1 is a side view (an inside of a right foot) showing a roller skate according to the present invention.
Figure 2:
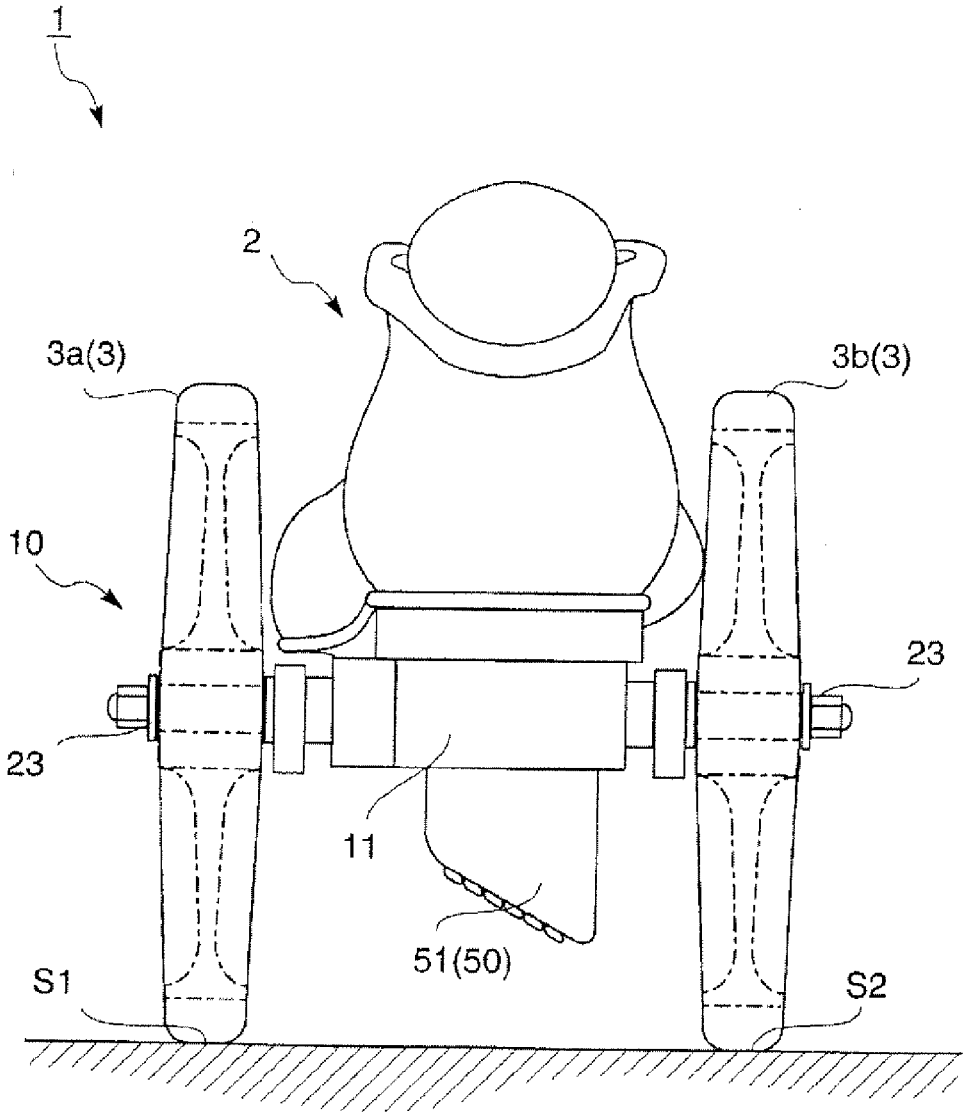
FIG. 2 is a rear view (a right foot) showing a roller skate according to the present invention.
Figure 3:
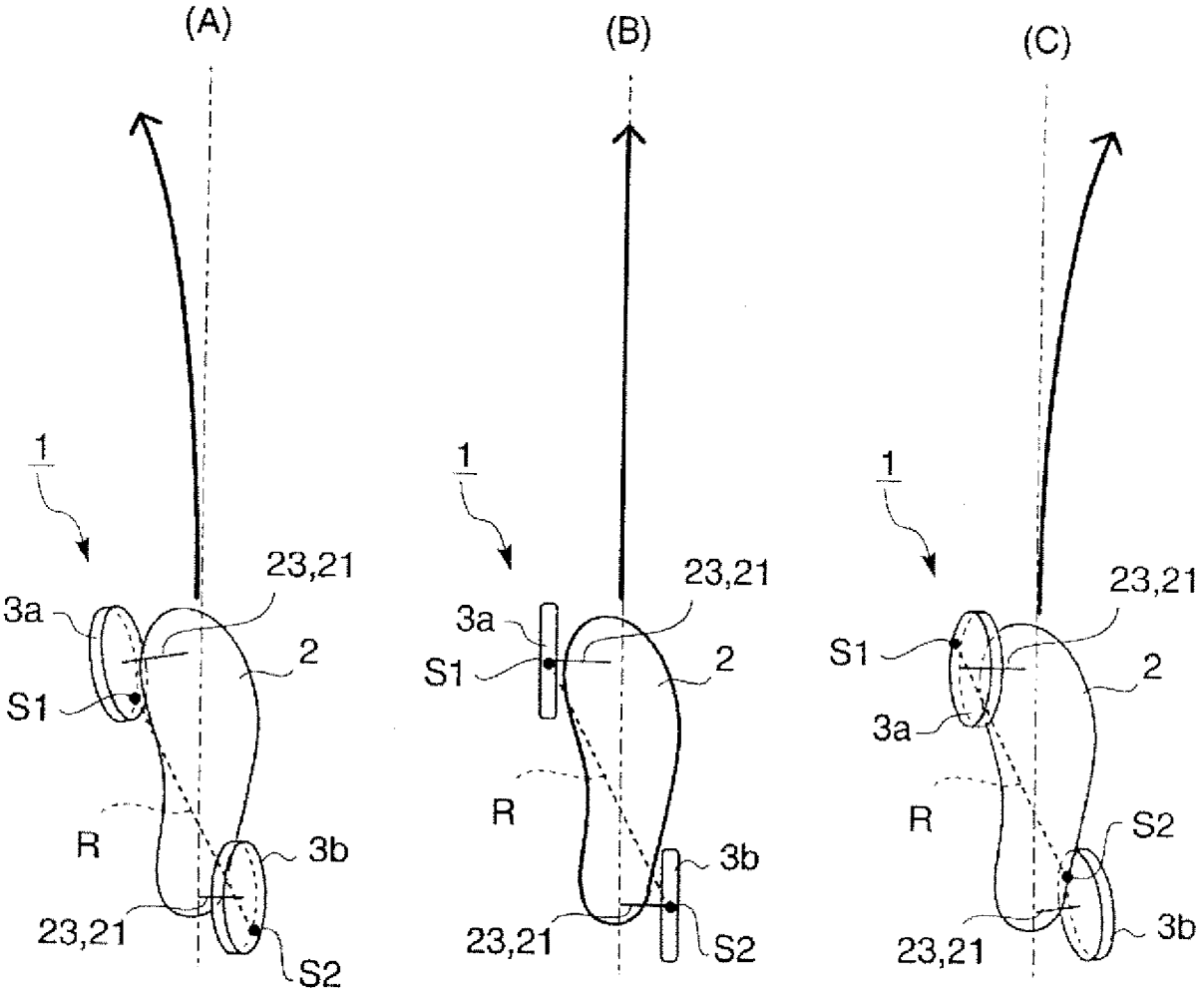
FIGS. 3 (A), (B), and (C) are schematic plan views of a roller skate according to the present invention.
Figure 4:
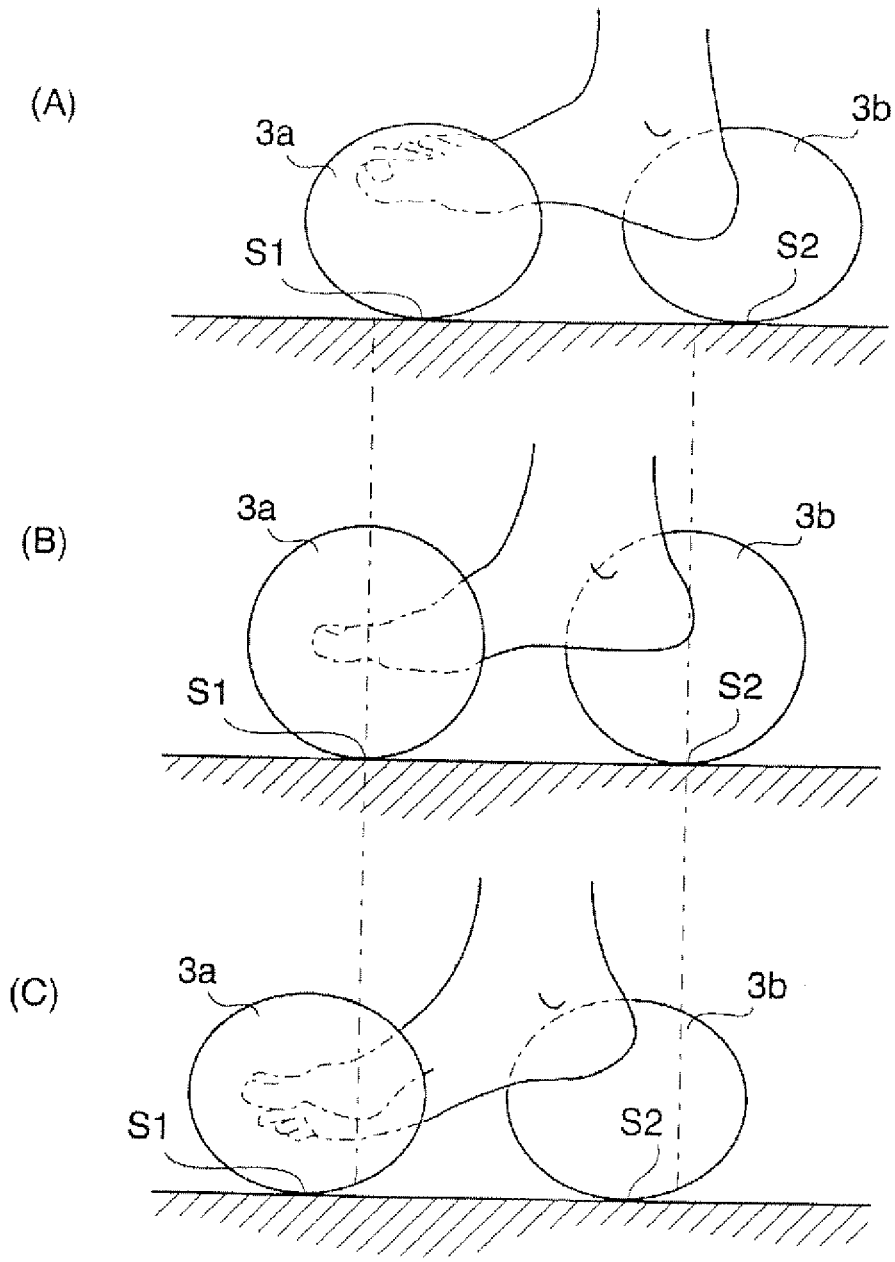
FIGS. 4 (A), (B), and (C) are schematic side views of a roller skate according to the present invention.
Figure 5:
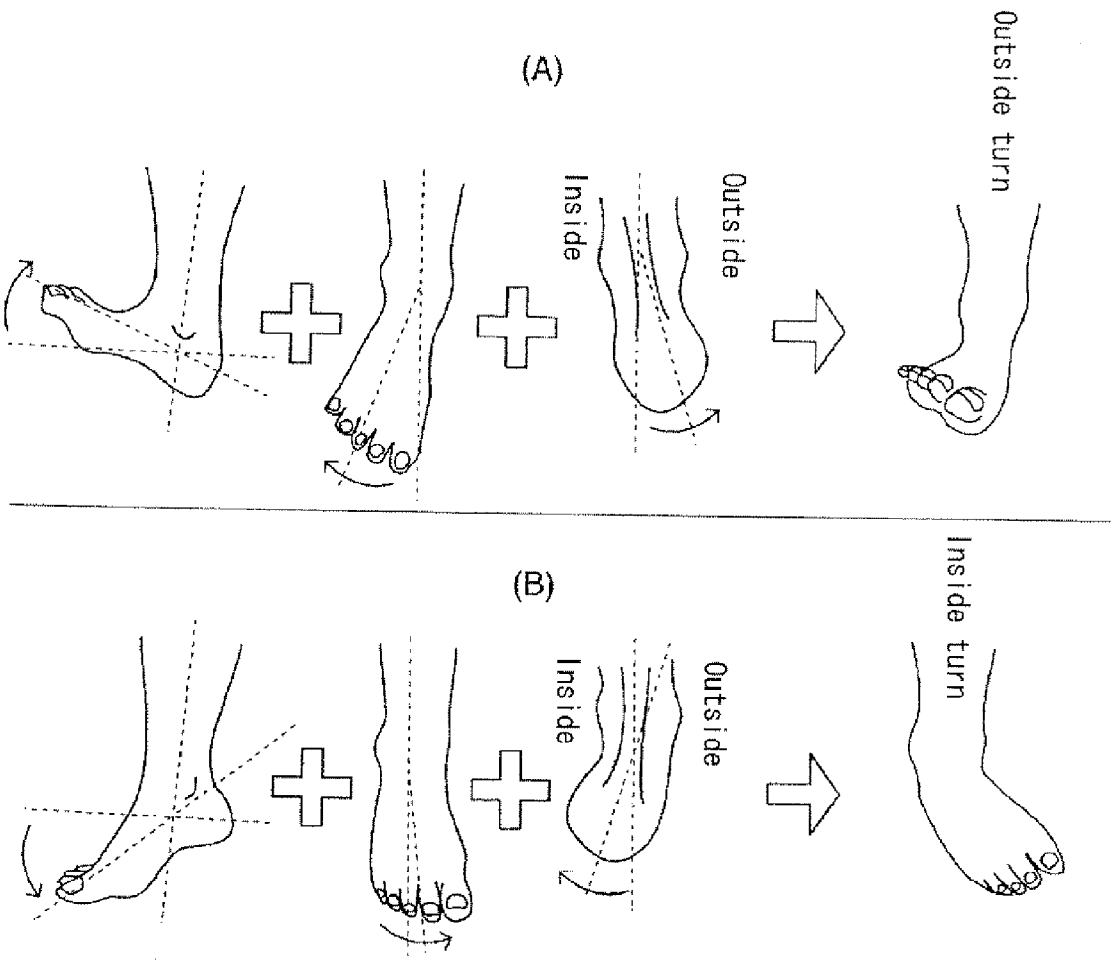
FIGS. 5 (A) and (B) are schematic views showing how to bend an ankle based on ergonomics.
Figure 6:
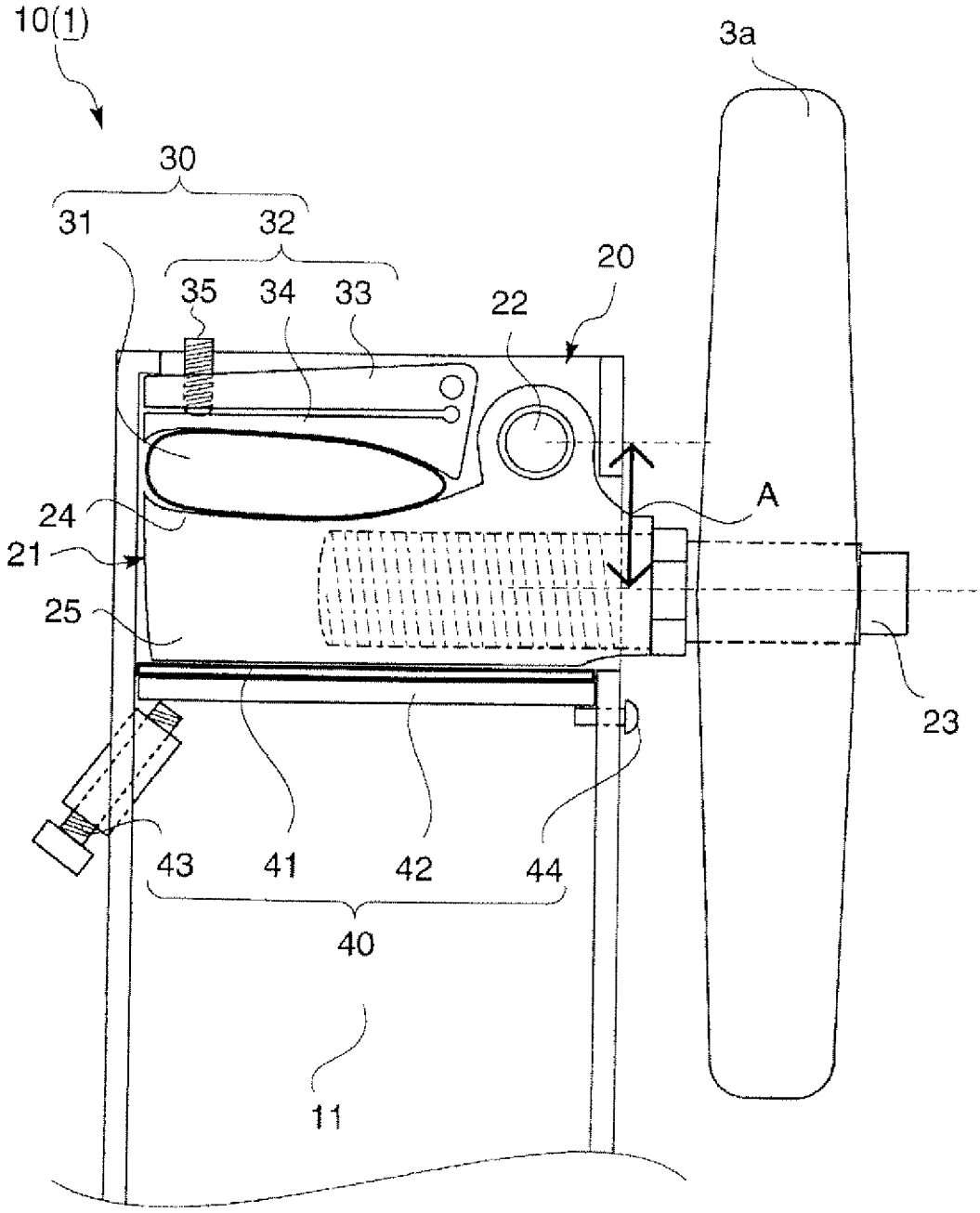
FIG. 6 is a bottom view showing angle varying means according to the present invention (neutral position).
Figure 7:
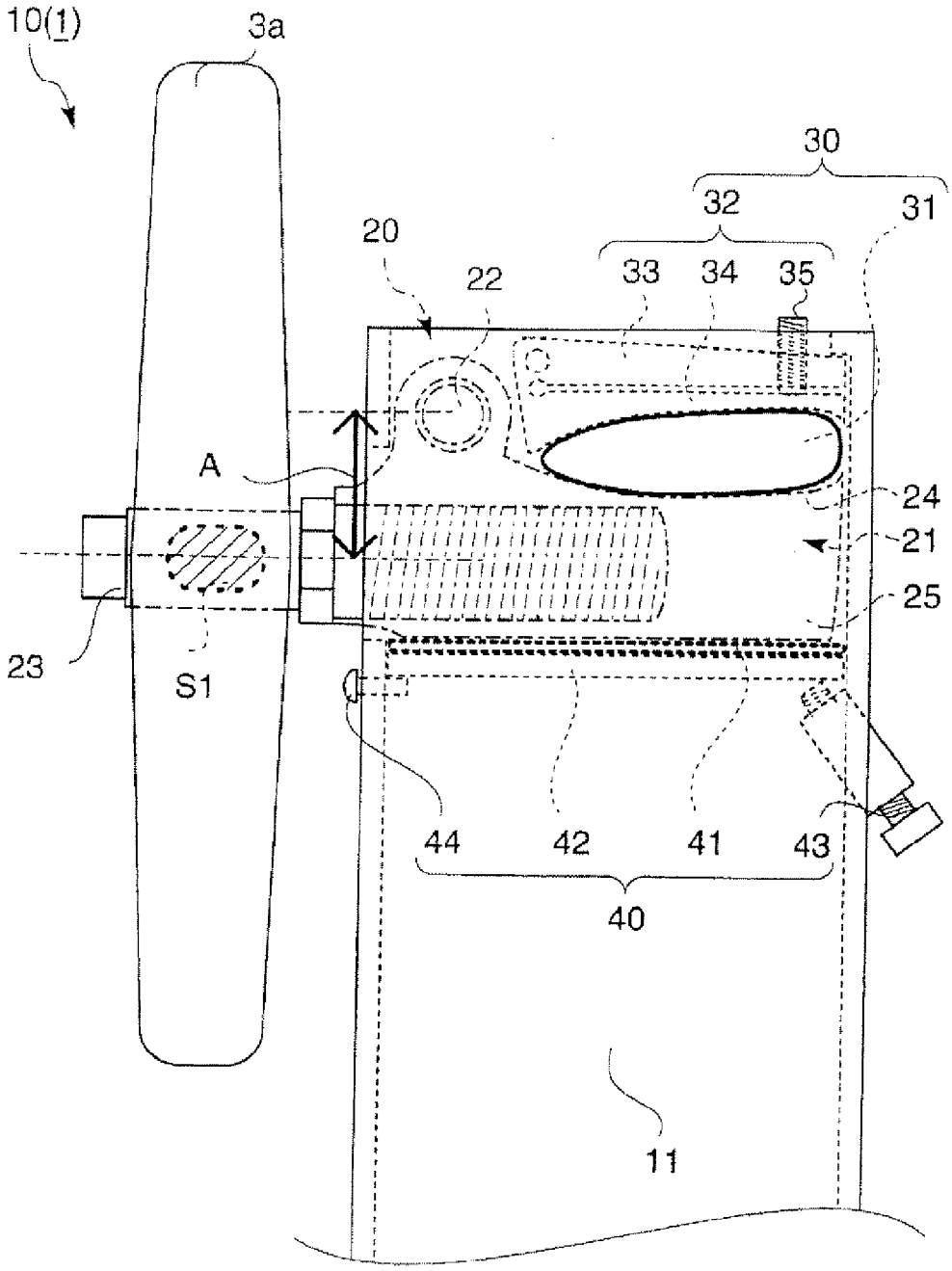
FIG. 7 is a plan view showing angle varying means according to the present invention (neutral position).
Figure 8:
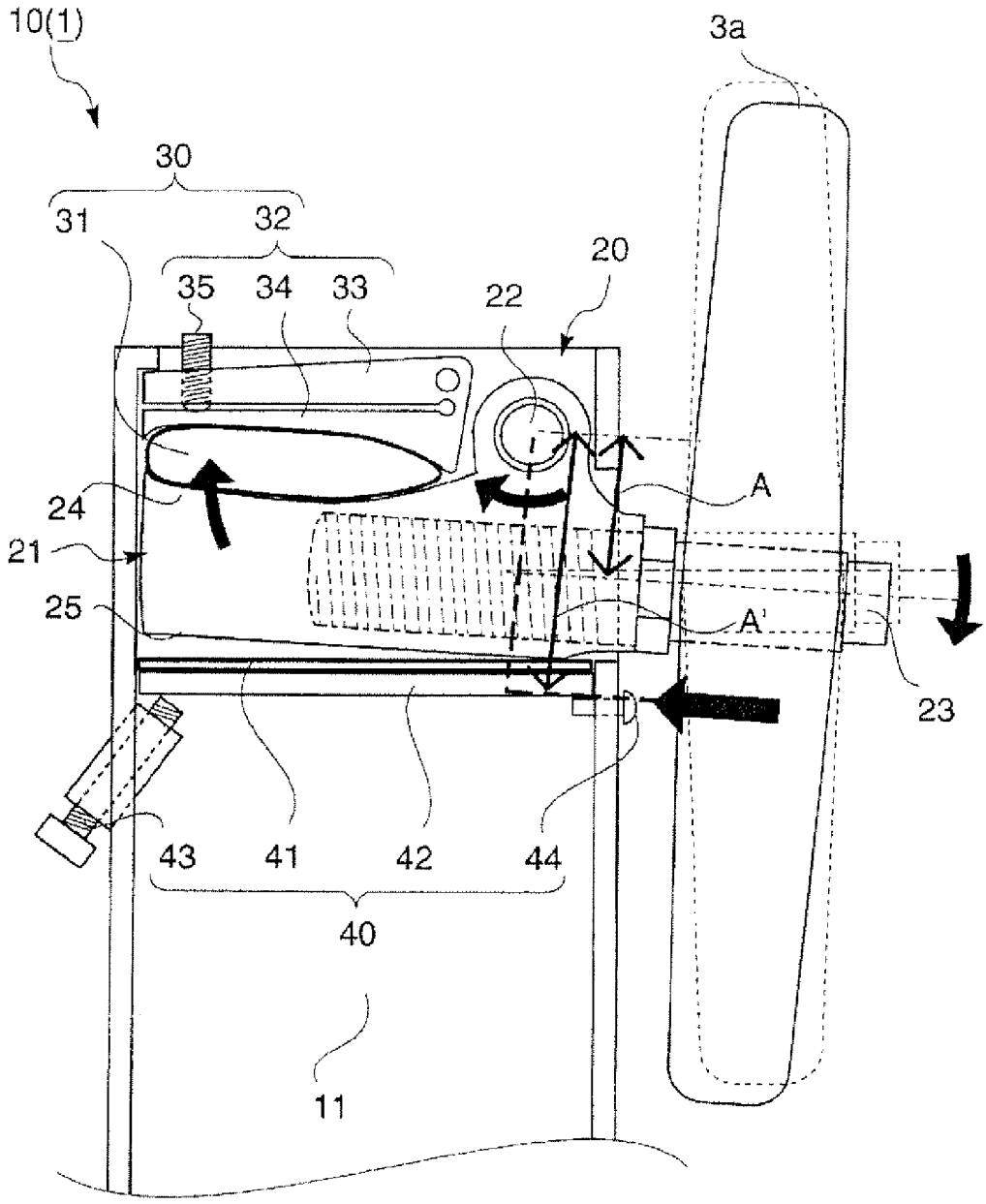
FIG. 8 is a bottom view showing angle varying means according to the present invention (swinging status).
Figure 9:
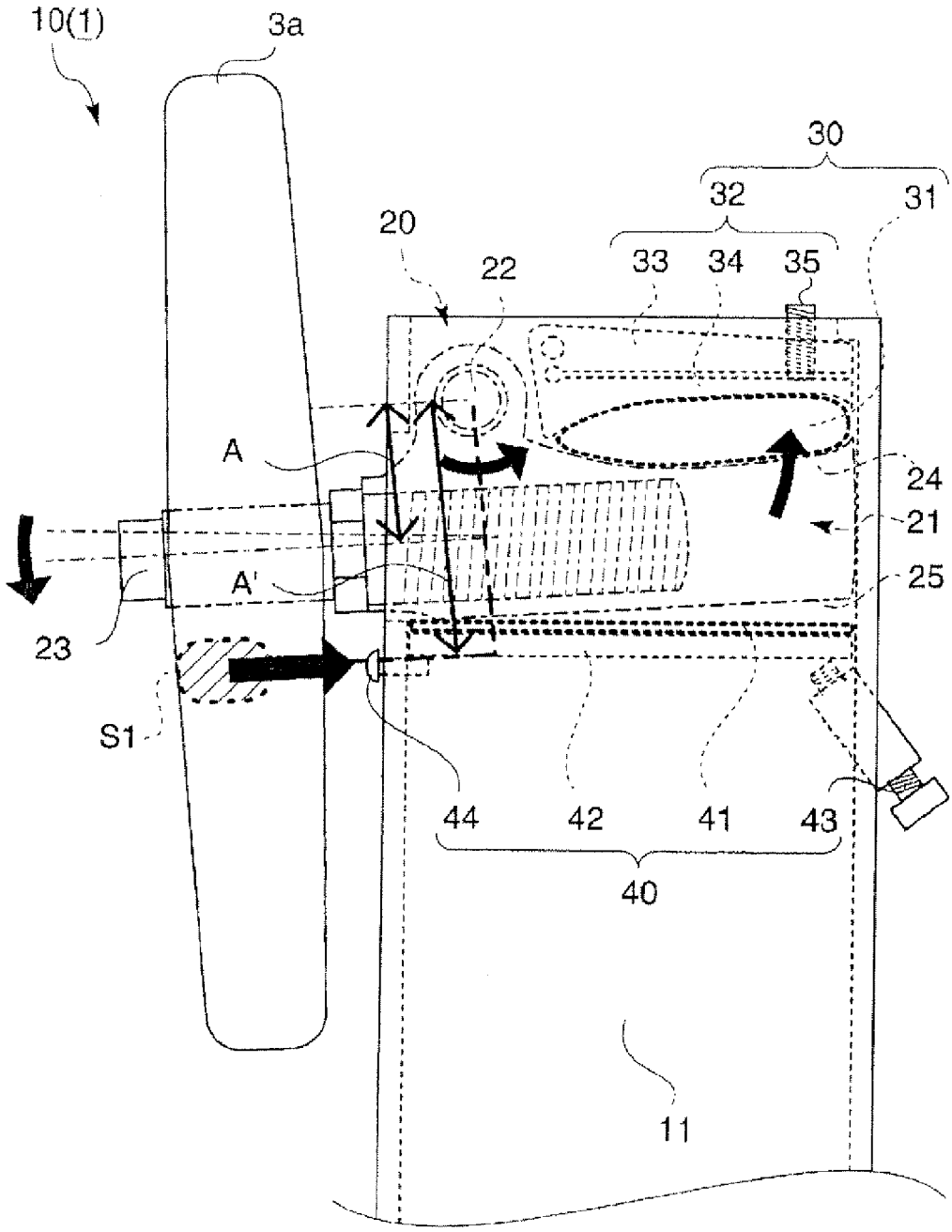
FIG. 9 is a plan view showing angle varying means according to the present invention (swinging status).
Figure 10:
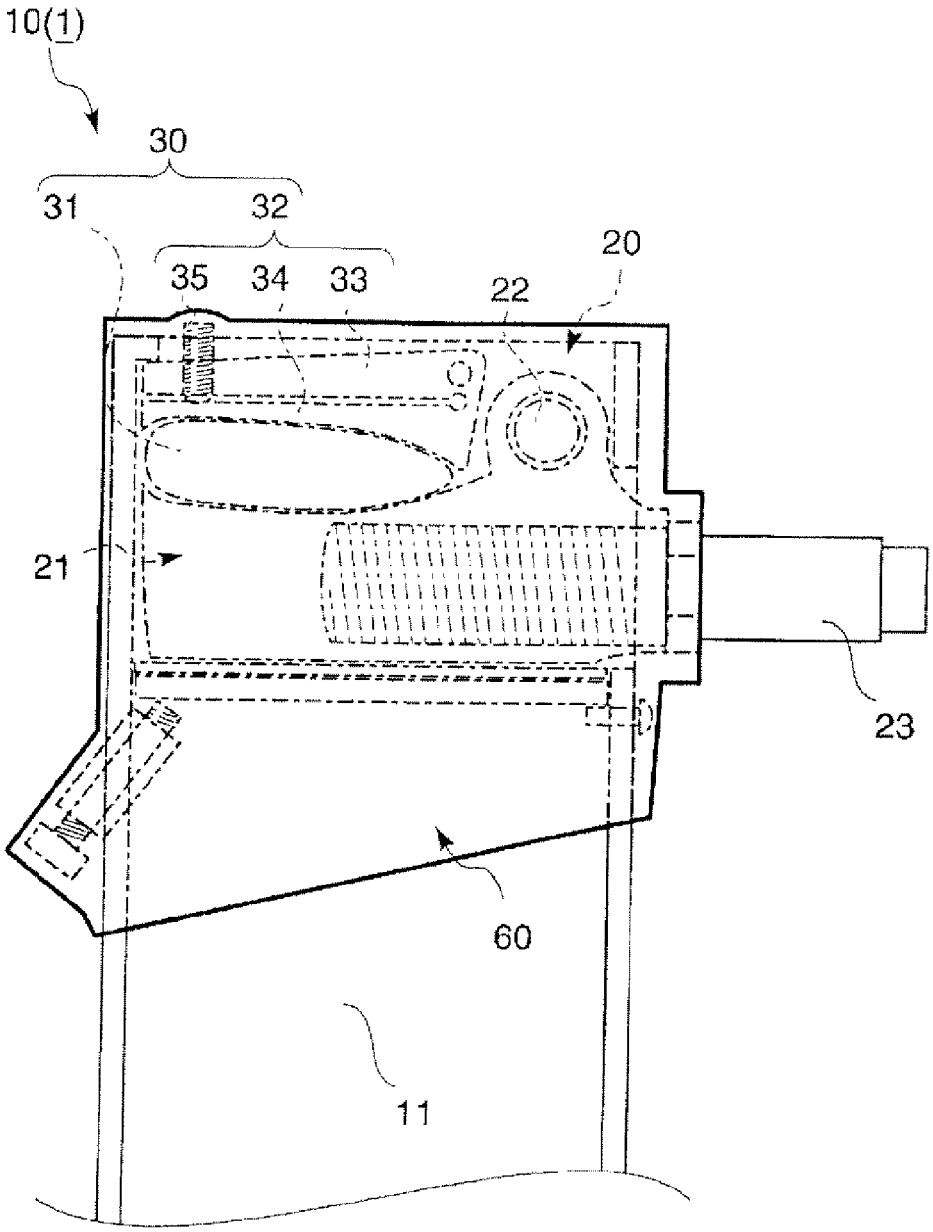
FIG. 10 is a bottom view showing a cover member according to the present invention.
Figure 11:
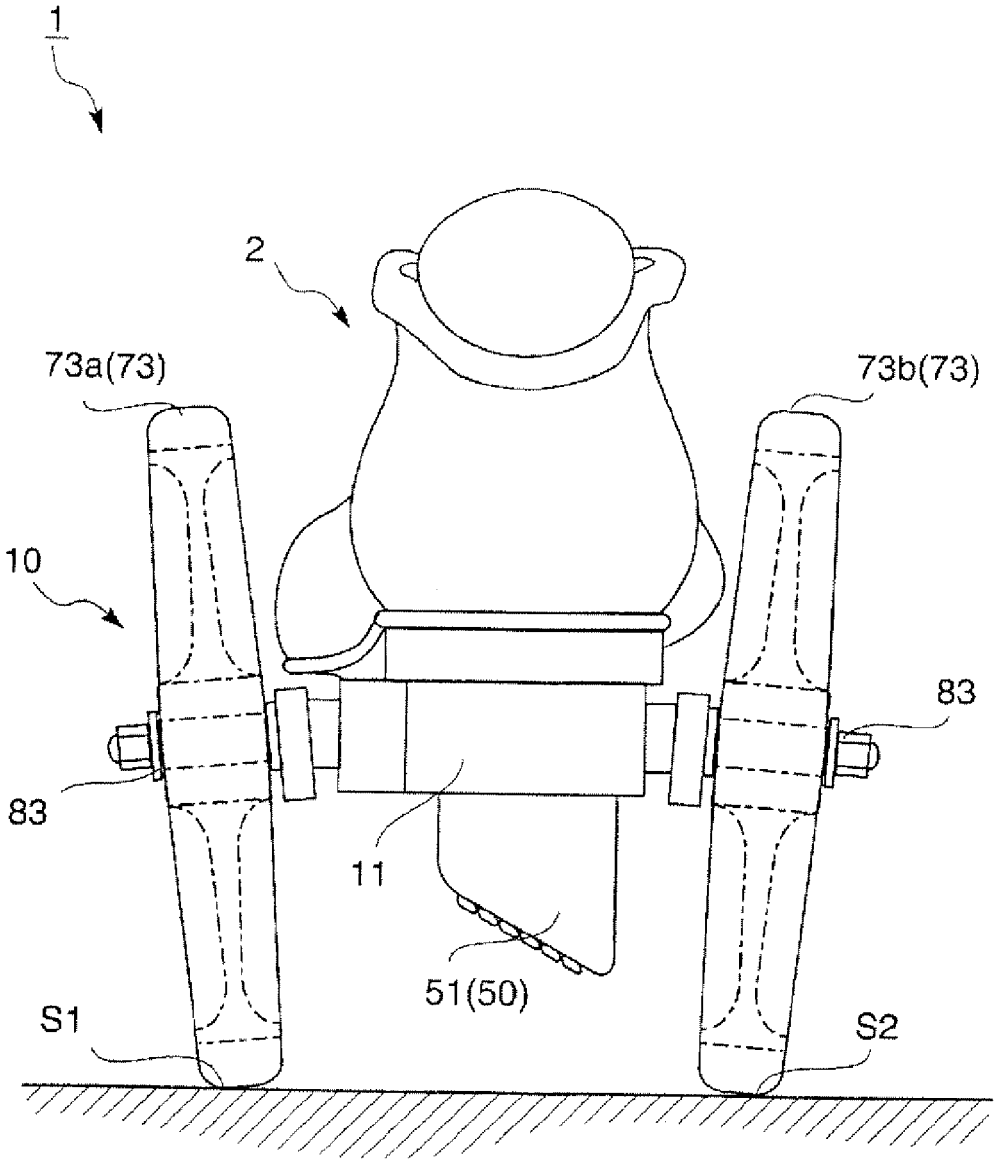
FIG. 11 is a rear view (a right foot) showing a roller skate according to other embodiment 1.
Figure 12:
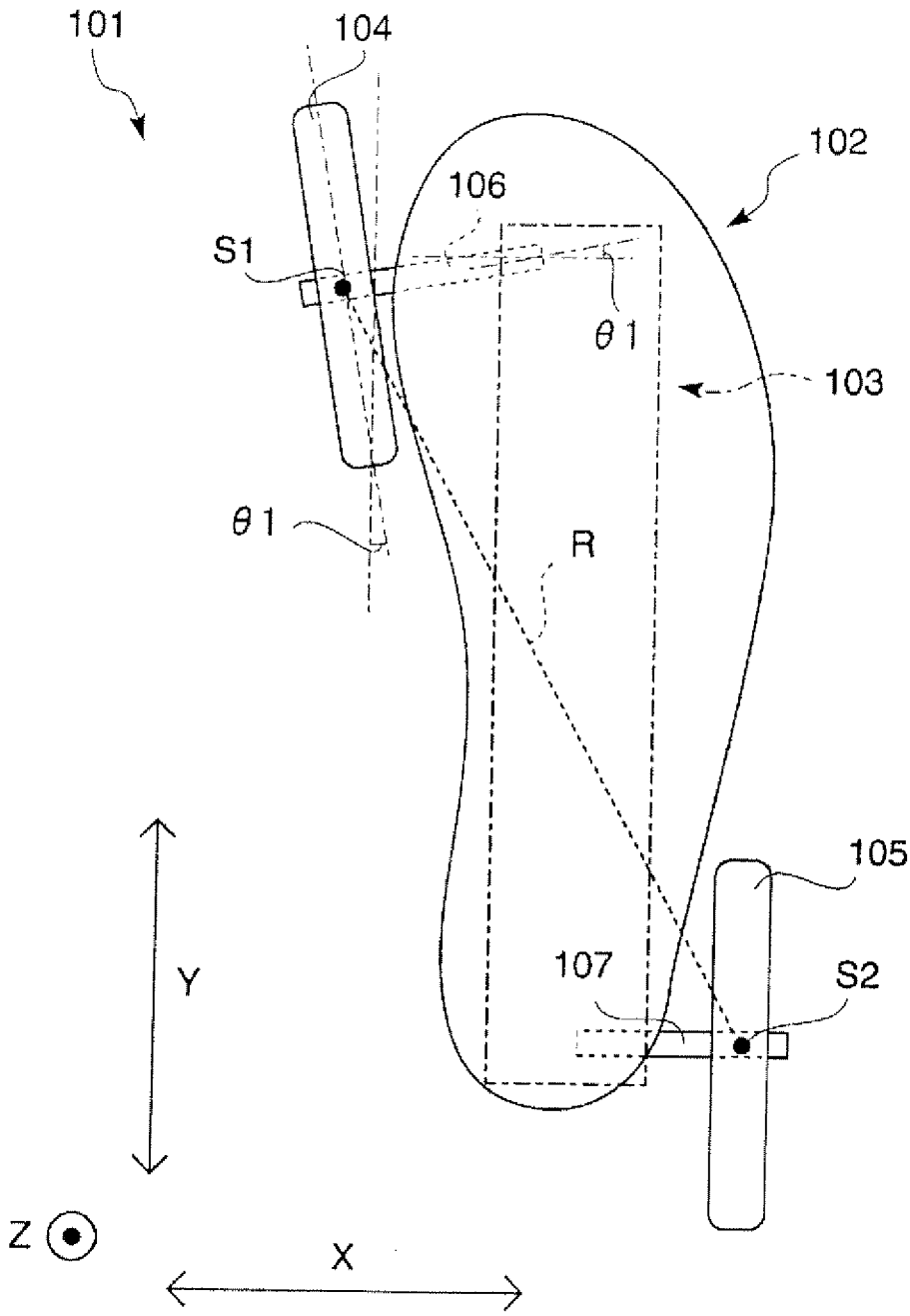
FIG. 12 is a plan view (a right foot) showing a roller skate according to other embodiment 2.
Figure 13:
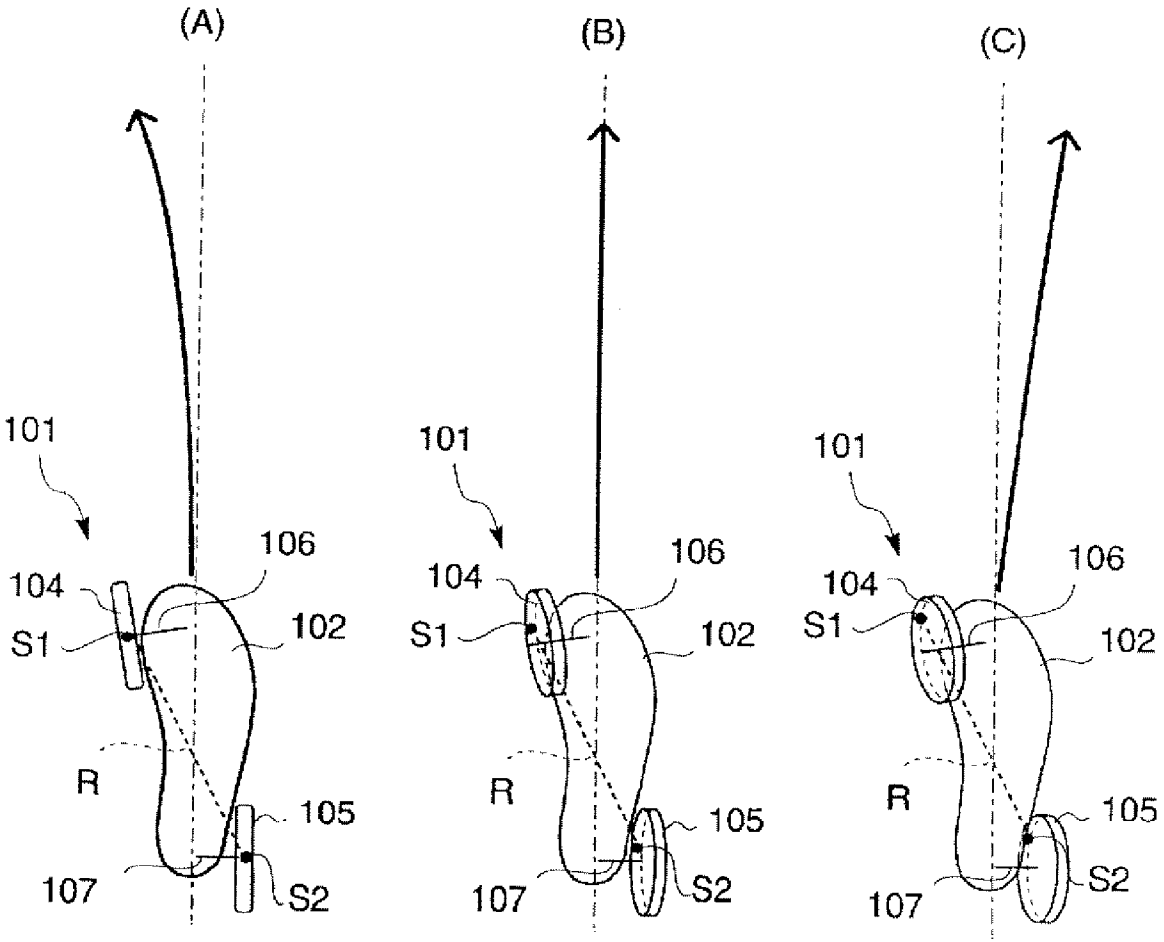
FIGS. 13 (A), (B), and (C) are schematic plan views of a roller skate according to other embodiment 2.
Figure 14:
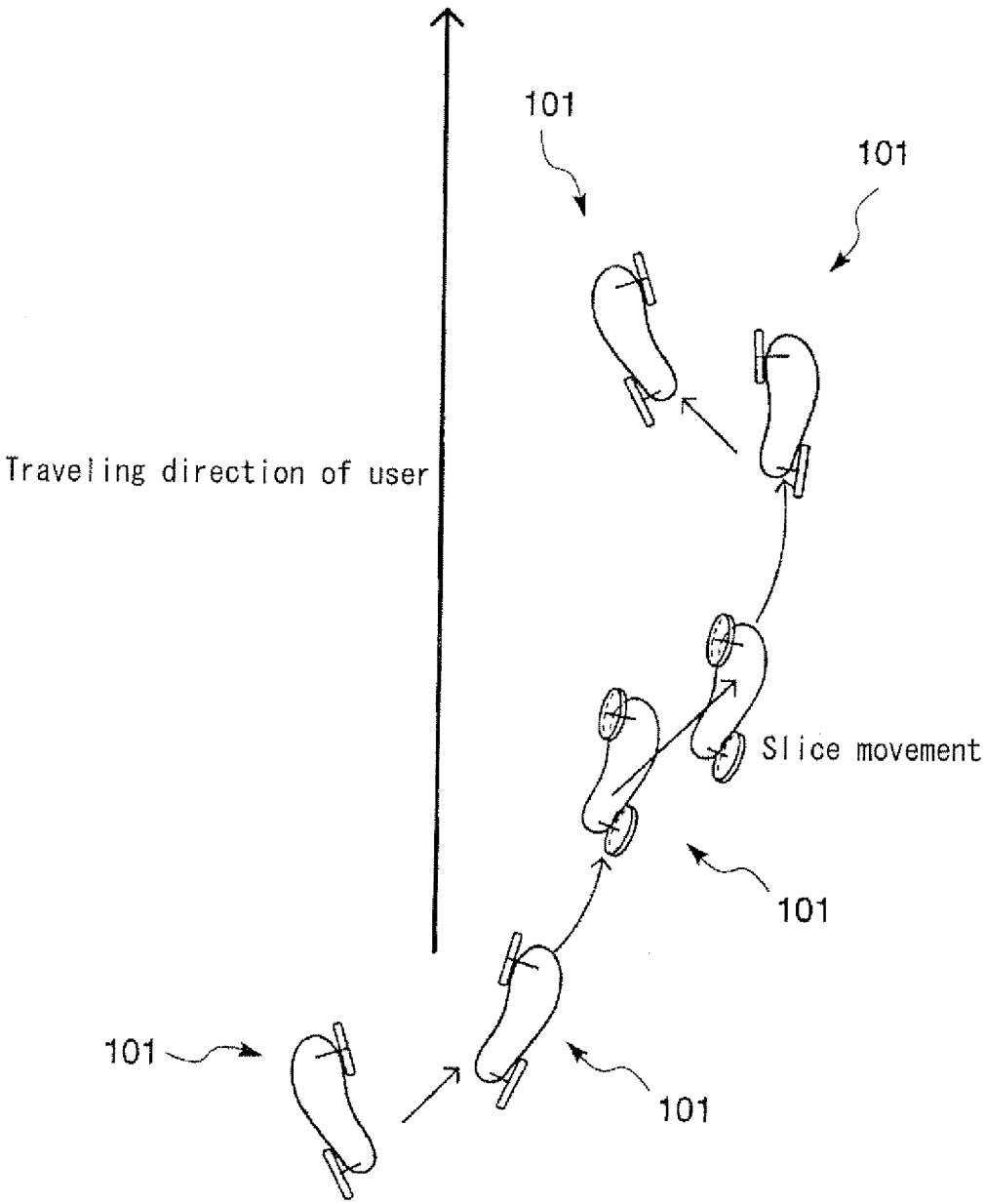
FIG. 14 is a drawing showing how to slide on roller skates according to other embodiment 2.
Figure 15:
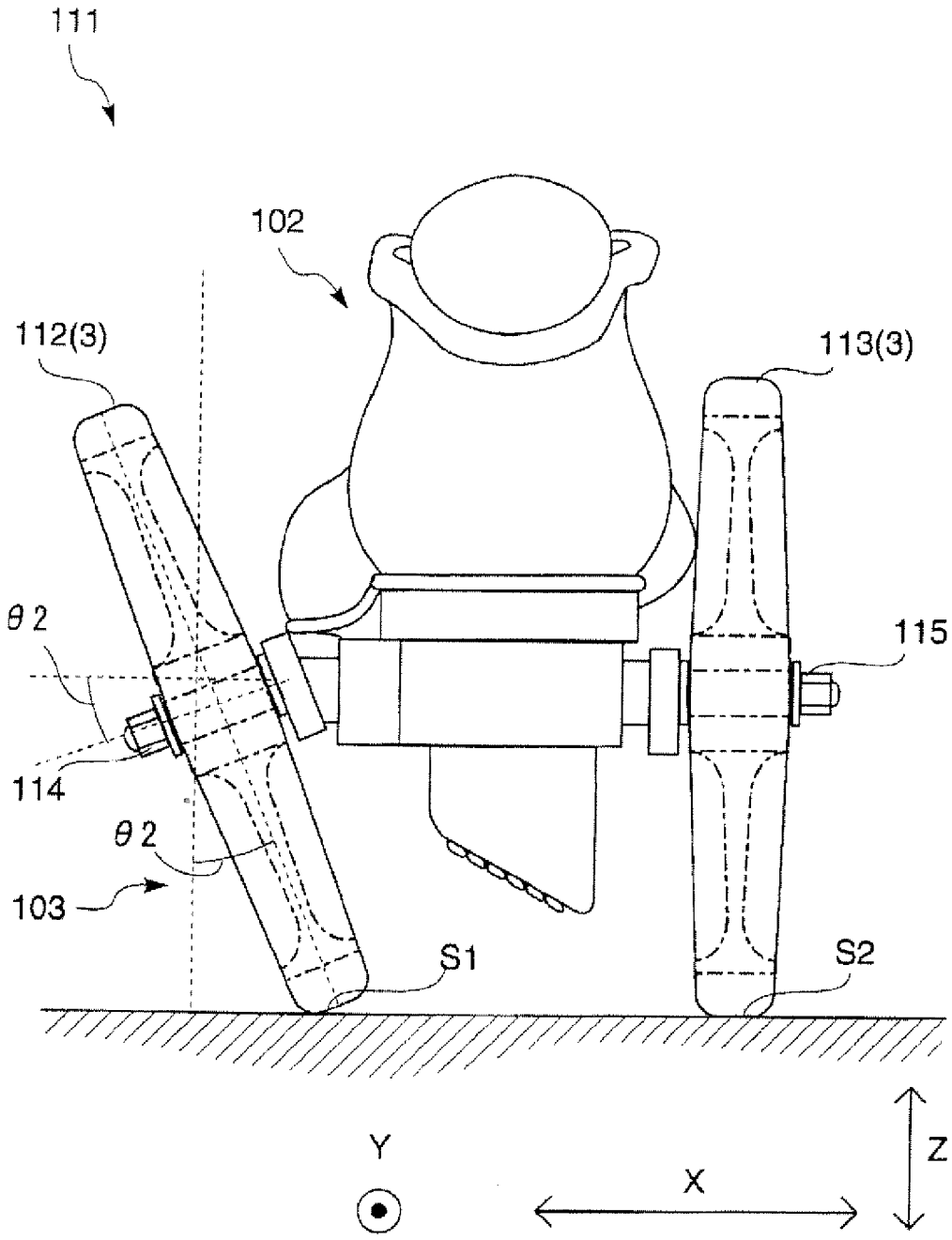
FIG. 15 is a rear view (a right foot) showing a roller skate according to other embodiment 3.
Figure 16:
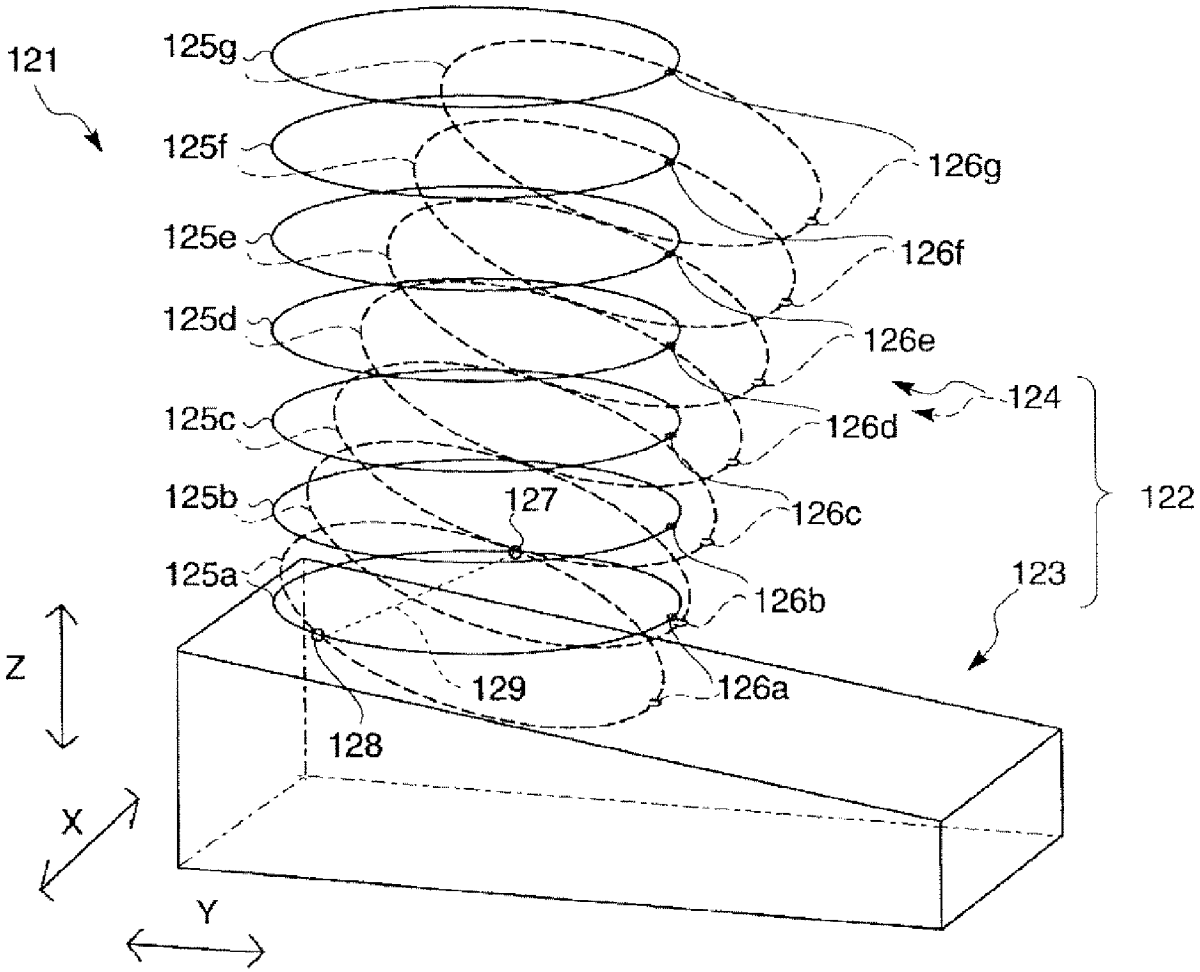
FIG. 16 is a schematic perspective view (a right foot) showing a roller skate according to other embodiment 4.
Figure 17:
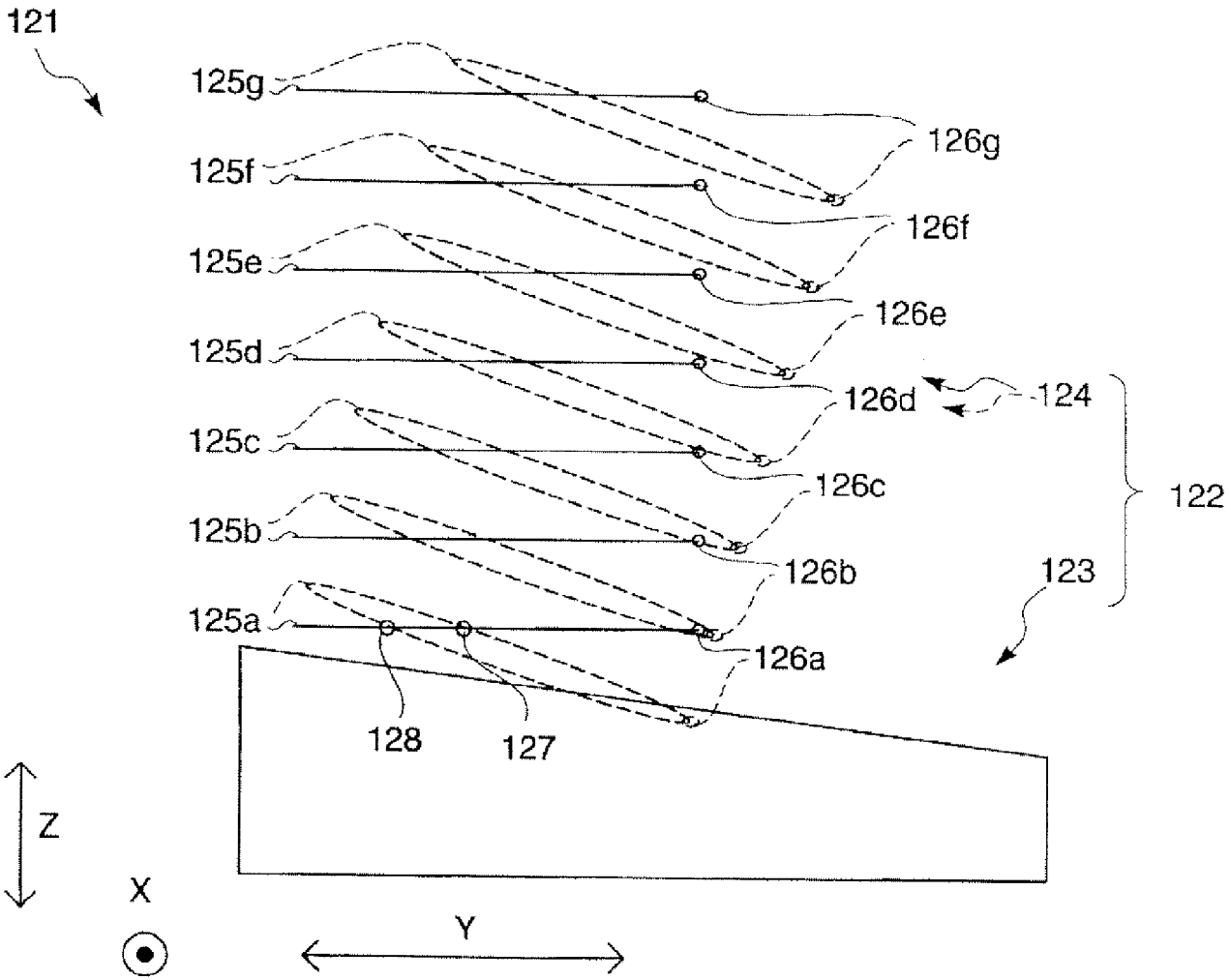
FIG. 17 is a schematic side view (a right foot) showing the roller skate according to other embodiment 4.
Figure 18:
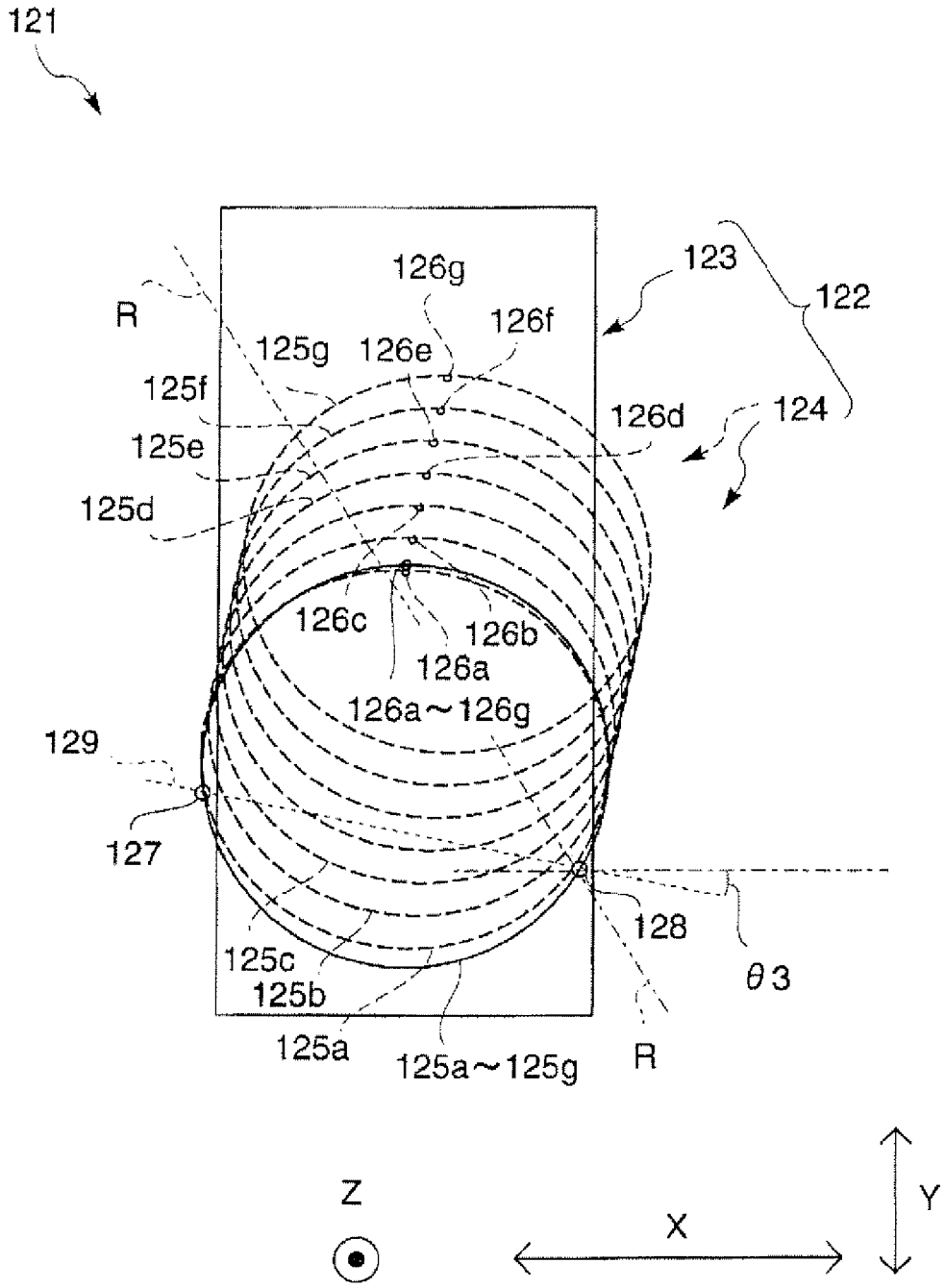
FIG. 18 is a schematic plan view (a right foot) showing the roller skate according to other embodiment 4.
Figure 19:
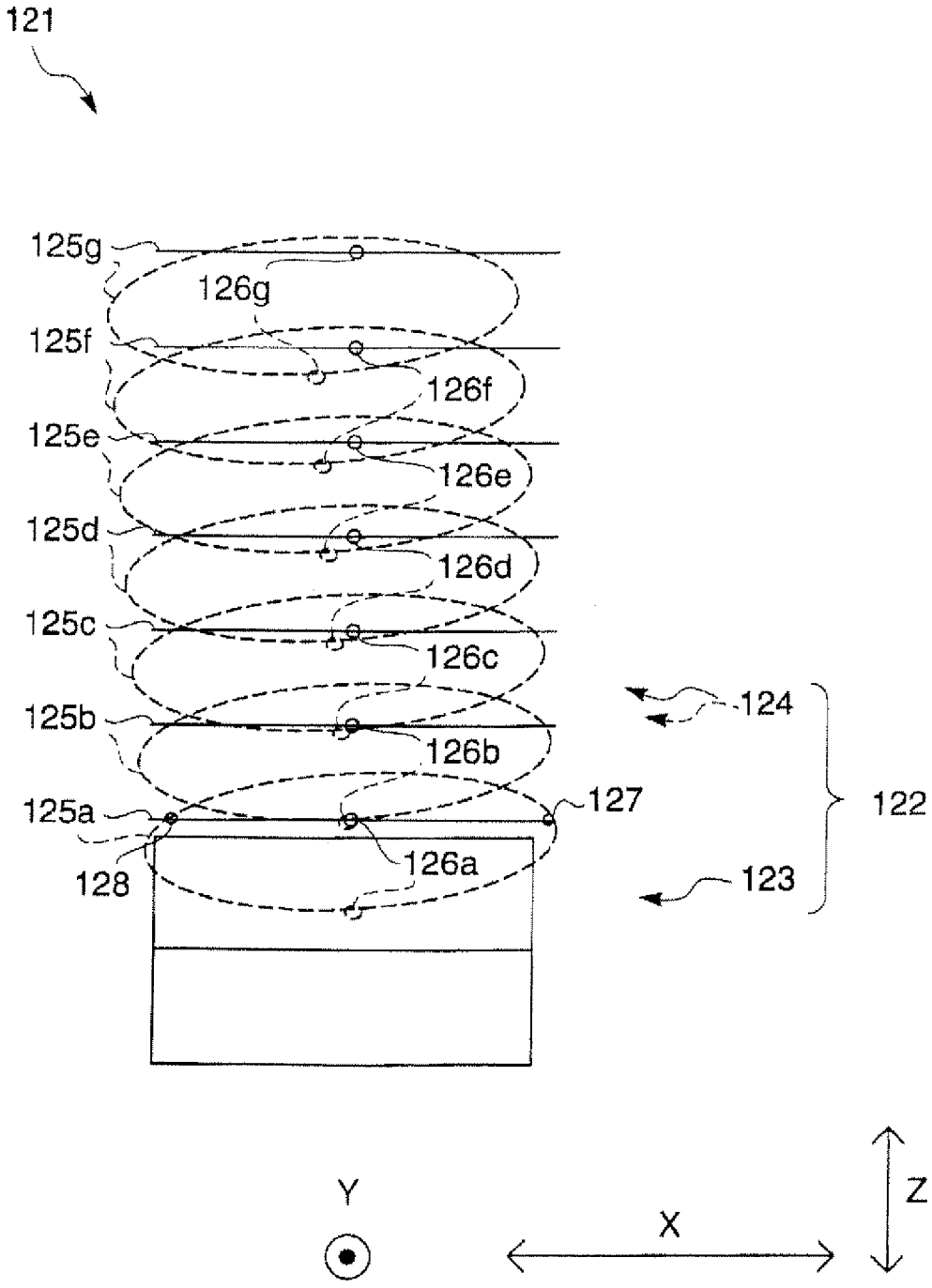
FIG. 19 is a schematic front view (a right foot) showing the roller skate according to other embodiment 4.
Figure 20:
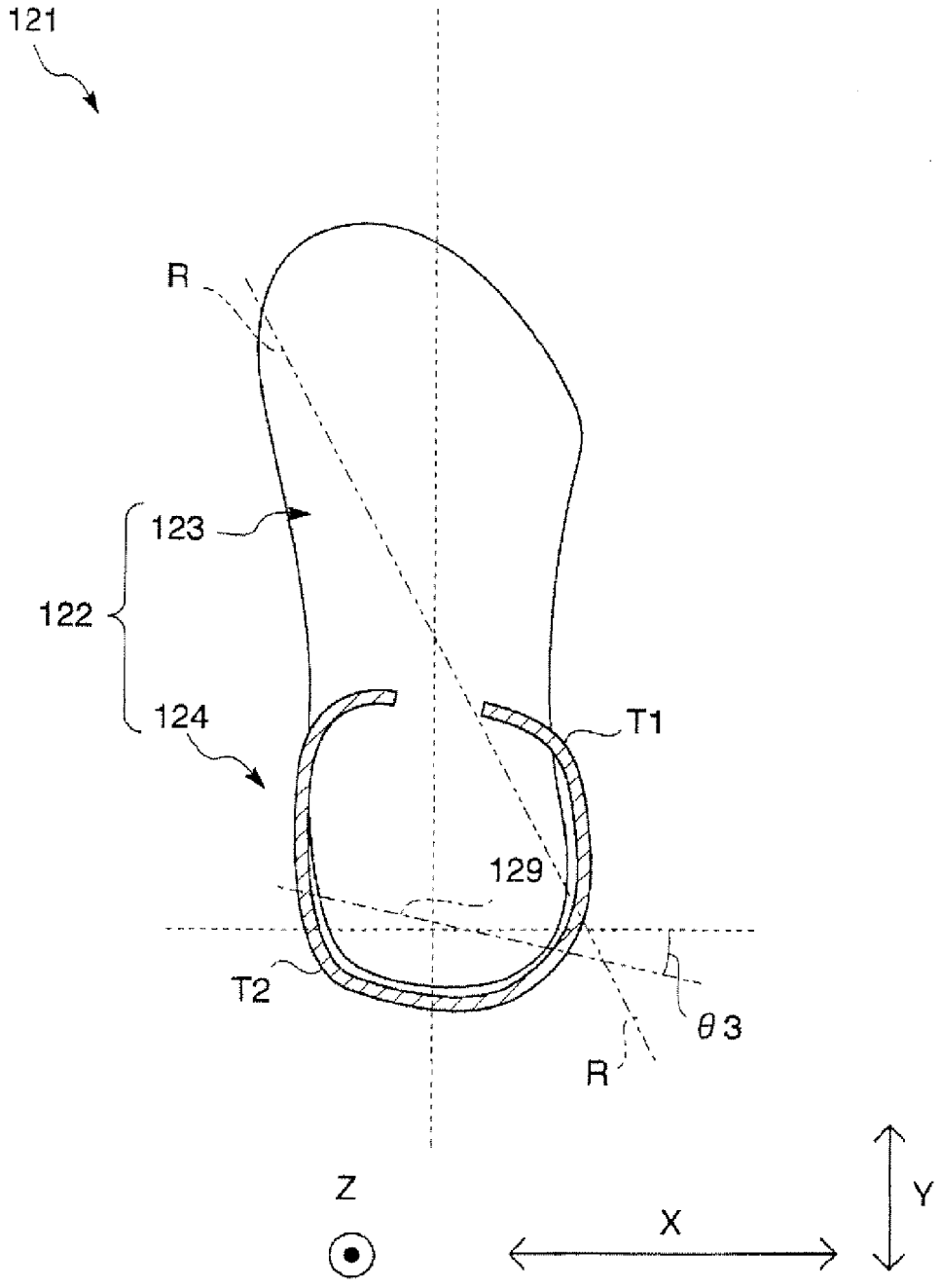
FIG. 20 is a schematic cross-sectional plan view (a right foot) showing the roller skate according to other embodiment 4.
Figure 21:
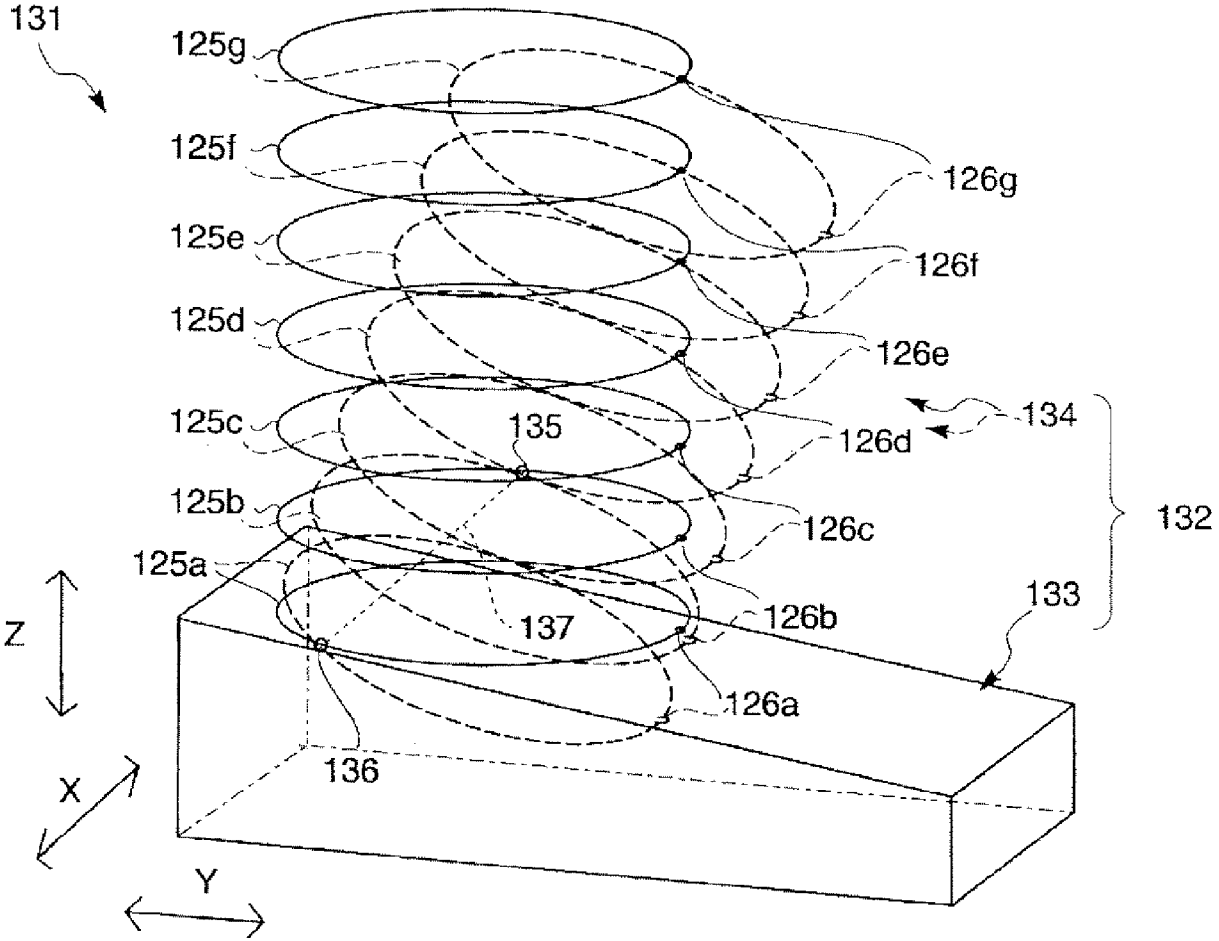
FIG. 21 is a schematic perspective view (a right foot) showing a roller skate according to other embodiment 5.
Figure 22:
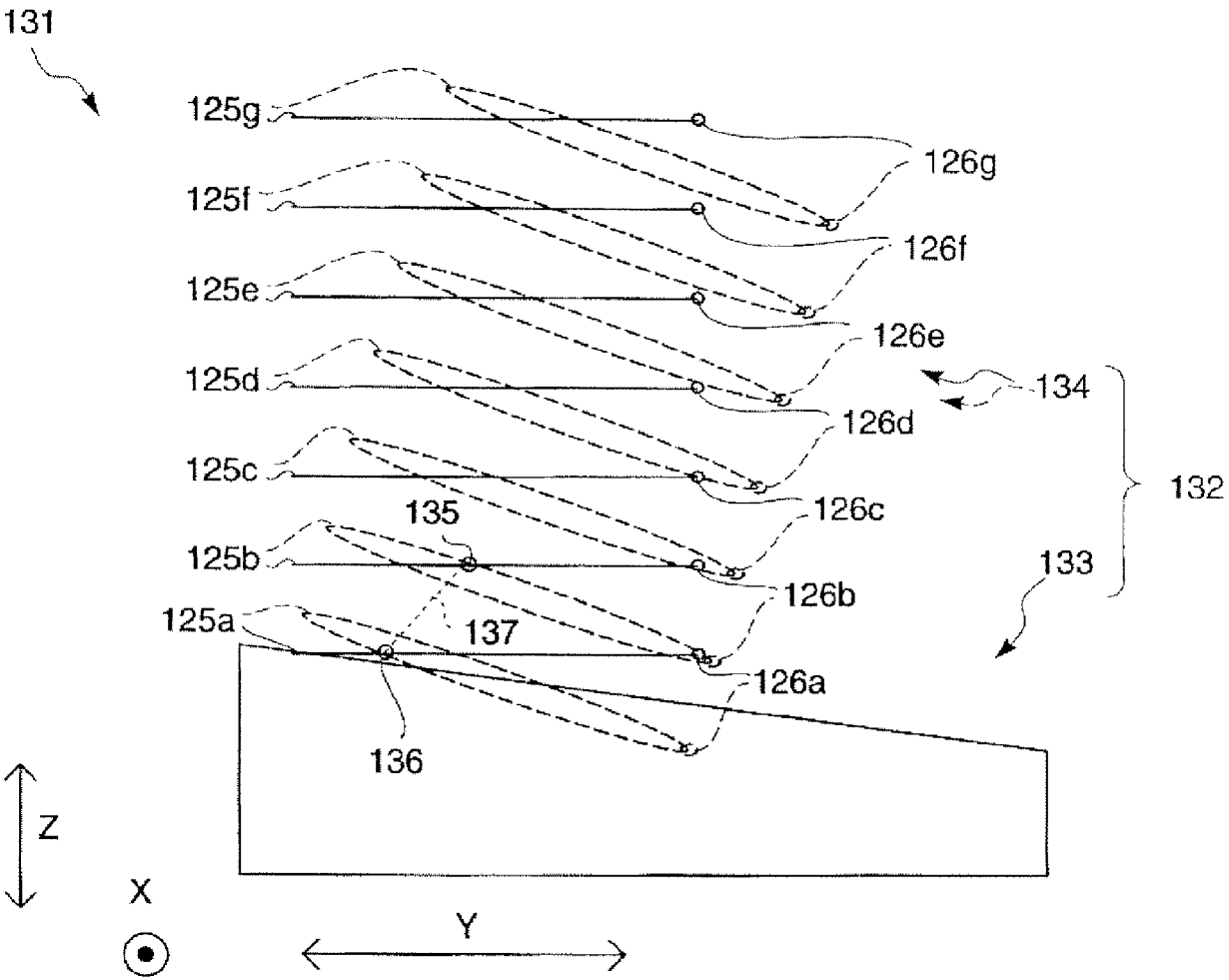
FIG. 22 is a schematic side view (a right foot) showing the roller skate according to other embodiment 5.
Figure 23:
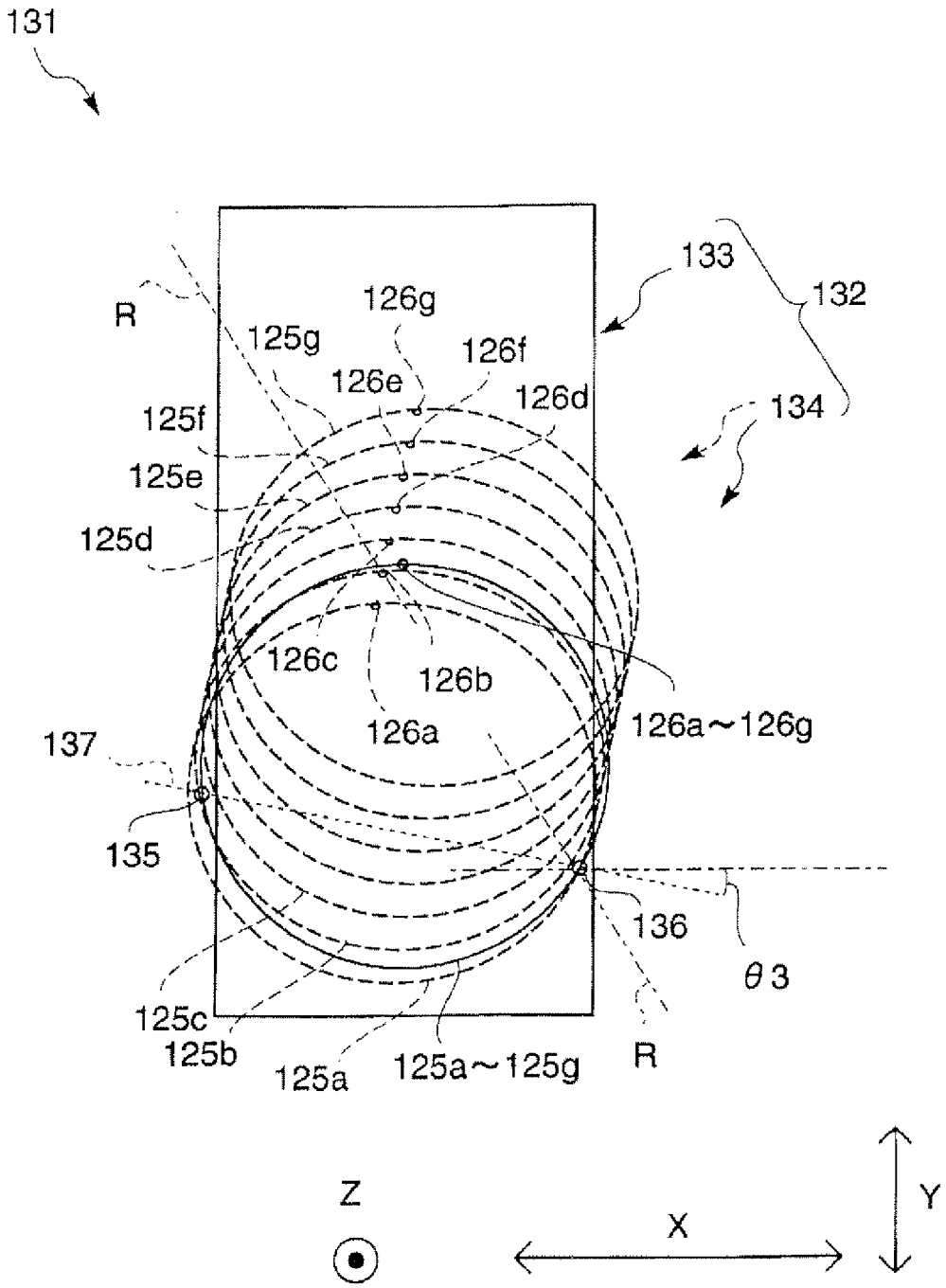
FIG. 23 is a schematic plan view (a right foot) showing the roller skate according to other embodiment 5.
Figure 24:
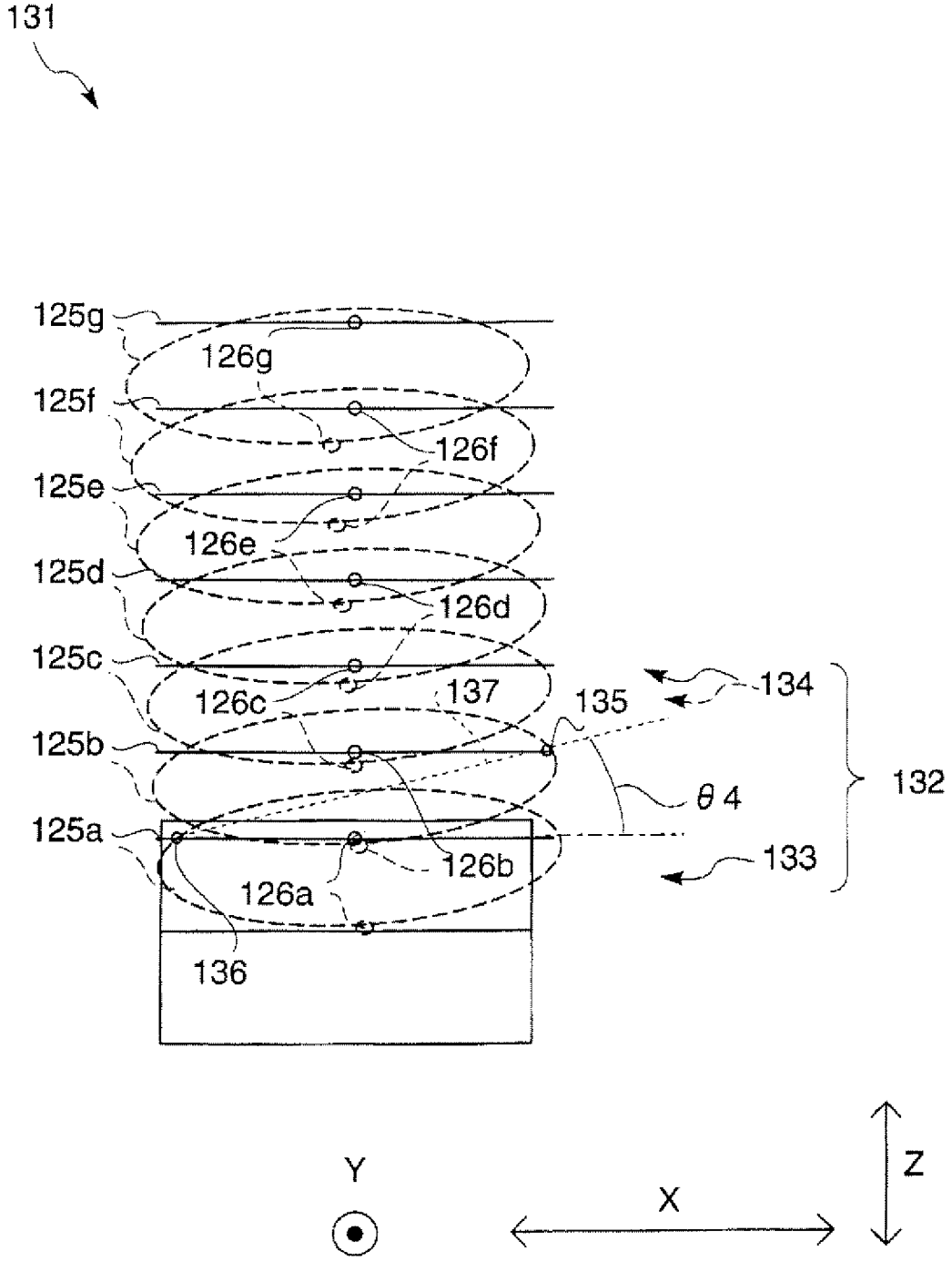
FIG. 24 is a schematic front view (a right foot) showing the roller skate according to other embodiment 5.
Figure 25:
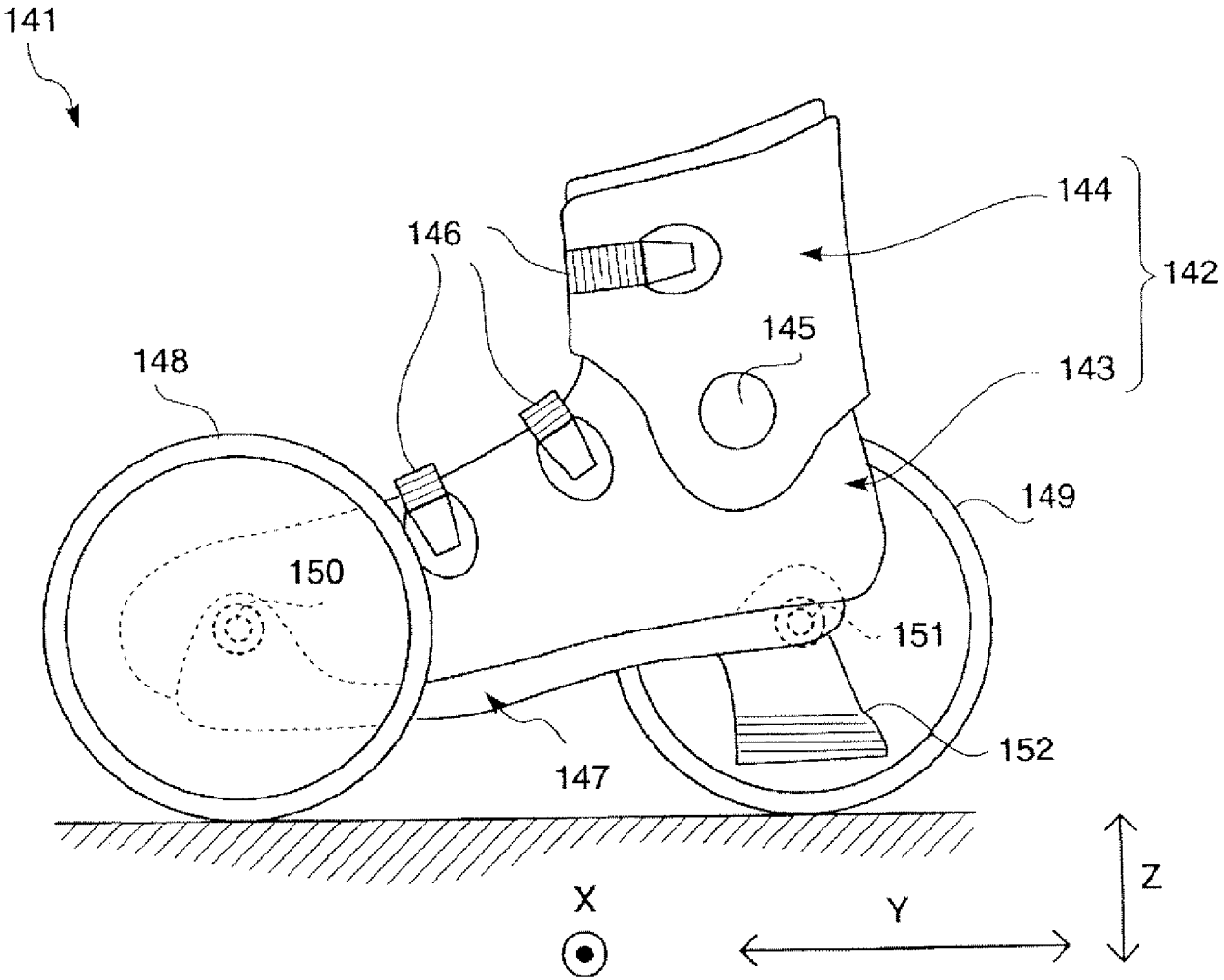
FIG. 25 is a side view (an inside of a right foot) showing a roller skate according to other embodiment 6.

The invention claimed is:

1. A pair of roller skates for a right foot and a left foot, each of the roller skates comprising:

one front wheel and one rear wheel; and a sole rotatably holding the front wheel and the rear wheel, wherein the front wheel is provided on the inside of a shoe body provided over the sole, a ground contact point of the front wheel is disposed inside of the shoe body and outward around the shoe body in planar view, the rear wheel is provided on the outside of the shoe body, a ground contact point of the rear wheel is disposed outside of the shoe body and outward around the shoe body in planar view, a diameter of the front wheel is the same as or smaller than a diameter of the rear wheel, a roll axis connecting the ground contact point of the front wheel and the ground contact point of the rear wheel intersects a center line of the shoe body extending in a longitudinal direction.

2. The roller skates according to any one of claim 1, wherein diameter of the wheel is constituted to be larger than distance from a ground contact point where the wheel touches the ground to the sole.

3. The roller skates according to any one of claims 2, wherein, of axles of the front wheel and the rear wheel, at least the position of the axle of the front wheel is located above the sole.

4. The roller skates according to any one of claim 1, wherein, of axles of the front wheel and the rear wheel, at least the position of the axle of the front wheel is located above the sole.

5. The roller skates according to any one of claims 1, 2 and 4, further comprising:

brake means that can cause deceleration during proceeding;

wherein the brake means is disposed on the inside of the rear wheel on the sole, and the brake means is provided to be able to touch the ground when the roller skate is inclined to the inside.

6. The roller skates according to any one of claims 1, 2 and 4, wherein the shoe body has a main body part that covers a foot and a cuff part provided rotatably in relation to the main body part that covers a leg, and where a width direction of the shoe body is an X-axis direction, a longitudinal direction of the shoe body is a Y-axis direction, and a direction orthogonal to the X-axis direction and the Y-axis direction is the Z-axis direction, a rotation axis of the cuff part is constituted to incline to a side of a line that connects a ground contact point of the front wheel and a ground contact point of the rear wheel in relation to the X-axis direction.

7. The roller skates according to claim 6, wherein an inclination angle of the rotation axis of the cuff part in relation to the X-axis direction is constituted to be 35 degrees or less.

8. The roller skates according to claim 6, wherein the rotation axis of the cuff part is constituted to have the inside inclining toward the upper side to become distant in relation to the X-axis direction on a surface formed by the X-axis and the Z-axis.

9. The roller skates according to claim 8, wherein the inclination angle of the rotation axis of the cuff part in relation to the X-axis direction on the surface formed by the X-axis and the Z-axis is constituted to be 30 degrees or less.

10. The roller skates according to claim 7, wherein the rotation axis of the cuff part is constituted to have the inside inclining toward the upper side to become distant in relation to the X-axis direction on a surface formed by the X-axis and the Z-axis.

11. The roller skates according to claim 1, wherein axles of the front wheel and the rear wheel are attached to a side portion of the sole and positioned below a foot part of the shoe body.

* * * * *